US010619286B2

(12) United States Patent
Pesavento et al.

(10) Patent No.: US 10,619,286 B2
(45) Date of Patent: Apr. 14, 2020

(54) METHOD FOR ESTIMATING THE AMOUNT OF LAUNDRY LOADED IN A ROTATING DRUM OF A LAUNDRY WASHING MACHINE

(71) Applicant: Electrolux Appliances Aktiebolag, Stockholm (SE)

(72) Inventors: Elena Pesavento, Porcia (IT); Fabio Altinier, Porcia (IT); Terenzio Girotto, Porcia (IT); Lorenzo Corso, Porcia (IT); Piero Stocco, Porcia (IT); Andrea De Bernardo, Ljungby (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 64 days.

(21) Appl. No.: 15/767,270

(22) PCT Filed: Oct. 26, 2016

(86) PCT No.: PCT/EP2016/075757
§ 371 (c)(1),
(2) Date: Apr. 10, 2018

(87) PCT Pub. No.: WO2017/072156
PCT Pub. Date: May 4, 2017

(65) Prior Publication Data

US 2019/0055689 A1 Feb. 21, 2019

(30) Foreign Application Priority Data

Oct. 26, 2015 (EP) ..... 15191511
Apr. 26, 2016 (EP) ..... 16167014

(51) Int. Cl.
*D06F 39/00* (2020.01)
*D06F 33/02* (2006.01)

(52) U.S. Cl.
CPC ..... *D06F 39/003* (2013.01); *D06F 33/02* (2013.01); *D06F 2202/10* (2013.01); *D06F 2204/065* (2013.01)

(58) Field of Classification Search
CPC .. D06F 39/003; D06F 2204/065; D06F 33/02; D06F 2202/10; D06F 35/005;
(Continued)

(56) References Cited

U.S. PATENT DOCUMENTS 7,299,515 B2 * 11/2007 Oh ..... D06F 39/003 700/130
8,196,440 B2 * 6/2012 Hosoito ..... D06F 33/02 68/12.04

(Continued)

FOREIGN PATENT DOCUMENTS

| | | |
|---|---|---|
| DE | 19857903 A1 | 6/1999 |
| DE | 10305675 B3 | 5/2004 |
| EP | 2837732 A1 | 2/2015 |

OTHER PUBLICATIONS

International Search Report and Written Opinion for International Application No. PCT/EP2016/075757, dated Jan. 24, 2017, 11 pages.

*Primary Examiner* — Brandi N Hopkins
(74) *Attorney, Agent, or Firm* — RatnerPrestia

(57) ABSTRACT

A method to control a laundry machine. The method includes: controlling an electric motor to rotate a drum to change the rotational speed according to a prefixed reference speed profile comprising an acceleration ramp from a low speed to a prefixed high speed and a constant speed phase at the high speed, sampling first torque values generated by the motor during the acceleration ramp according to a first sample time, sampling second torque values generated by the motor during the constant speed phase according to a second sample time, calculating a third value indicative of
(Continued)

an average torque being calculated on the basis of the second torque values, determining a fourth value by performing an integral function with respect to the first torque values less the third value, and determining the amount of laundry load on the basis of the fourth value.

18 Claims, 10 Drawing Sheets

(58) Field of Classification Search
CPC ..... D06F 37/203; D06F 2202/065; D06F 2222/00; D06F 2202/12; D06F 2204/086; D06F 2204/10
See application file for complete search history.

(56) References Cited

U.S. PATENT DOCUMENTS

| | | | | |
|---|---|---|---|---|
| 9,096,964 | B2 | 8/2015 | Albayrak et al. | |
| 2005/0066999 | A1* | 3/2005 | Dietz | D06F 35/006 134/18 |
| 2011/0005339 | A1 | 1/2011 | Ashrafzadeh et al. | |
| 2013/0098119 | A1* | 4/2013 | Koo | D06F 33/02 68/12.16 |
| 2013/0305462 | A1* | 11/2013 | Gasparini | D06F 33/02 8/137 |

* cited by examiner

METHOD FOR ESTIMATING THE AMOUNT OF LAUNDRY LOADED IN A ROTATING DRUM OF A LAUNDRY WASHING MACHINE

This application is a U.S. National Phase application of PCT International Application No. PCT/EP2016/075757, filed Oct. 26, 2016, which claims the benefit of European Application No. EP 15191511.3, filed Oct. 26, 2015, and European Application No. EP16167014.6, filed Apr. 26, 2016, of which are incorporated by reference herein.

The present invention concerns to a method for obtaining information about the amount of laundry (i.e. weight) loaded in a laundry drum of a laundry washing machine.

BACKGROUND ART

Nowadays the use of laundry washing machines, both "simple" laundry washing machines (i.e. laundry washing machines which can only wash and rinse laundry) and washing-drying machines (i.e. laundry washing machines which can also dry laundry), is widespread.

In this respect, in the present description, where not stated differently, the term "laundry treatment machine" can be referred indiscriminately to a laundry washing machine, or to a laundry washing and drying machines, or to a laundry drying machine.

Laundry washing machines are apparatuses for removing contaminants from laundry by the action of detergent and water and may have a configuration based on a rotating drum that defines a washing chamber in which laundry items are placed for washing according to one or more washing cycles/programs.

Generally, laundry washing machines are provided with controllers being configured to sense the amount of the laundry loaded in the rotating drum in order to set several parameters of the washing cycle, such as for example, the amount of water/detergent to be loaded, the cycle duration, and other washing parameters, based on the sensed laundry amount.

In some kind of known laundry treatment machines, controllers are configured to perform a control method that, at the beginning of the washing cycle, indirectly estimates the amount of laundry loaded in the rotating drum based on the water absorbed by the laundry. Indeed, the amount of water loaded during the water loading phase in a washing cycle, is proportional to the amount and type of laundry loaded in the drum. Based on the amount of water adsorbed in a prefixed time, an algorithm executed by the controller estimates the laundry quantity loaded in the drum.

This method has the problem to take long time, i.e. several minutes, to complete the estimation of the laundry load. Indeed the method may estimate the load, only after completion of the water loading procedure of the washing cycle, that generally takes up more than 15 minutes.

Furthermore, the accuracy of the estimation is low because it strongly depends on the water absorbing degree of the fabric/textile of the loaded laundry. Laboratory test made by Applicant demonstrated, for example, that two kg of sponge laundry absorbs as much water as five kg of cotton laundry.

It is therefore evident that kind of fabric/textile may strongly affect the accuracy of the estimation and, in some cases/conditions, provides completely wrong indication, unless the algorithms makes appropriate corrections to the estimated load value according to the kind of the fabric/textile, i.e. by considering the selected cycle.

However such solutions, on one side, causes the machine to performs complex algorithms and, on the other side, is limited to washing programs associated to a specific kind of fabric/textile. Indeed, remaining washing programs, such as many general washing programs frequently used by users, do not contain specific information about the fabric/textile of the loaded laundry. Moreover, this solution is affected by error due to wrong selections of the washing programs made by users.

It is further prior art to determine the amount of laundry load by performing a different procedure, which is essentially based on the time dependence of the electric power supplied by the electric motor that drives the drums, operating in a generator mode, during a revolution of the rotating drum. In this regards, for example, U.S. Pat. No. 9,096,964 B2 discloses a method for determining the load of a laundry drum of a washing machine, comprising the steps of: accelerating the laundry drum to a predetermined rotational speed, slowing down the laundry drum by operating the electric motor in generator mode, measuring electric currents flowing through the winding of the stator during the generator mode, calculating energy supplied by the electrical motor within a predetermined time interval when slowing down the rotating drum based on current and determining the load from the calculated energy.

It is the aim of the present invention to provide a method for determining the laundry load, which is simple, cheap and quick, and further improves the precision compared with the above mentioned methods.

It is thus the object of the present invention to provide a solution which allows achieving the objectives indicated above.

DISCLOSURE OF INVENTION

According to the present invention, it is provided a method for determining a laundry load of a laundry treating machine, said laundry treating machine comprises: an outer casing, a laundry treating group which is placed inside said outer casing and comprises, in turn, a rotatable drum structured for housing the laundry to be treated, an electric motor for rotating said drum, said method being characterized by comprising the steps of: controlling the electric motor to cause said drum to change the rotational speed according to a prefixed reference speed profile comprising at least an acceleration ramp, wherein the drum is accelerated from a low speed to a prefixed high speed and at least a constant speed phase wherein the drum speed is maintained about said high speed, sampling first torque values generated by said electric motor during said acceleration ramp according to a prefixed first sample time, sampling second torque values generated by said motor during said constant speed phase according to a prefixed second sample time, calculating a third value, which is indicative of an average torque being calculated, in turn, on the basis of said second torque values, determining a fourth value by performing an integral function with respect to said first torque values and said the third value, determining the amount of laundry load on the basis of at least said fourth value.

Preferably, said prefixed reference speed profile further comprises a deceleration ramp wherein said drum is decelerated from said high speed to said low speed; said constant speed phase being performed immediately after said acceleration ramp and immediately before said deceleration ramp.

Preferably, said fourth value is determined by performing said integral function with respect to said first torque values subtracted of said the third value.

Preferably, said fourth value is calculated according to the following equation:

$$\text{Torque_int}=[\Sigma_{i=1}^{N}(Ti-TU)]*\Delta ta$$

wherein $T_i$ are the torque values sampled during said acceleration ramp at instants i, N is the number of torque values sampled during said acceleration ramp, TU is the average torque calculated during said constant speed phase, Δta is the first sample time.

Preferably, said fourth value is calculated according to the following equation:

$$\text{Torque_int}=[(\Sigma_{i=1}^{N}Ti)-(TU*N))]*\Delta ta$$

wherein $T_i$ are the torque values sampled during said acceleration ramp, N is the number of torque values sampled during said acceleration ramp, TU is the average torque calculated during said constant speed phase, Δta is the first sample time.

Preferably, the method further comprises the steps of: determining a load index value based on said fourth value and determining the amount of the laundry load based on said index value.

Preferably, the load index value is determined based on the following equation $$\text{IDX}=A1*\text{Torque_int}$$

wherein A1 is a constant parameter experimentally calculated and Torque_int is said fourth value.

Preferably, said reference speed profile comprises a sequence of drum speed commutations, wherein each speed commutation comprises said acceleration ramp, said deceleration ramp and said constant speed phase; for each of said speed commutations, the method comprises the steps of: sampling said first torque values generated by said motor during said acceleration ramp according to said first sample time, sampling said second torque values generated by said motor during said constant speed phase according to said second sample time, calculating said third value, which is indicative of an average torque being calculated, in turn, on the basis of said second torque values, determining said fourth value by performing an integral function with respect to said first torque values and said third value, the method further comprising the steps of: calculating a fifth value which is indicative of the arithmetic mean of said fourth values; determining the amount of laundry load on the basis of differential values, calculated by subtracting said fifth value from said fourth values.

Preferably, said fourth value is determined by performing said integral function with respect to said first torque values subtracted of said the third value.

Preferably said fifth value is calculated according to the following equation:

$$(1/W)*[\Sigma_{k=1}^{W}\text{Torque_int}(k)]$$

wherein W is the number of speed commutations, Torque_int(k) are the fourth values associated with the respective commutation phases.

Preferably said differential values are calculated according to the following equation:

$$\text{Torque_diff}(k)=\text{Torque_int}(k)-(1/W)*[\Sigma_{k=1}^{W}\text{Torque_int}(k)]$$

wherein W is the number of speed commutations, Torque_int(k) are fourth values associated with the commutation phases.

Preferably the method further comprises the steps of: determining a load index value based on said fourth values and said differential values; determining the amount of the laundry load based on said index value.

Preferably, the method comprises the steps of comparing said laundry load index with one or more prefixed thresholds associated with respective amounts of laundry, and determine the laundry amount based on the comparison results.

Preferably, said second sample time of said second torque values generated by said electric motor during said constant speed phase is comprised between about $0.1*10^{-3}$ s and about $50*10^{-3}$ s.

Preferably, said second sample time of said second torque values generated by said electric motor during said constant speed phase is about $10*10^{-3}$ s.

Preferably, said first sample time of said first torque values generated by said electric motor during said acceleration ramp is comprised between about $0.1*10^{-3}$ s and $20*10^{-3}$ s.

Preferably, said first sample time of said first torque values generated by said motor during said acceleration ramp) is about $10*10^{-3}$ s.

Preferably, said constant speed phase has a duration of a prefixed time corresponding about the time spent by said drum to perform a prefixed number of whole revolutions at said high speed.

Preferably, said prefixed time corresponds to the time spent by the drum to perform two whole revolutions at said high speed.

The present invention further relates to a laundry treatment machine comprising: an outer casing, a laundry treating group which is placed inside said outer casing and comprises, in turn, a rotatable drum structured for housing the laundry to be treated, an electric motor for rotating said drum, characterized by comprising electronic control circuit configured to: control the electric motor to cause said drum to change the rotational speed according to a prefixed reference speed profile comprising at least an acceleration ramp, wherein said drum is accelerated from a low speed to a prefixed high speed and at least a constant speed phase wherein the drum speed is maintained about said high speed, sample first torque values generated by said motor during said acceleration ramp according to a prefixed first sample time, sample second torque values generated by said motor during said constant speed phase according to a prefixed second sample time, calculate a third value, which is indicative of an average torque being calculated, in turn, on the basis of said second torque values, determine a fourth value by performing an integral function with respect to said first torque values and said third value, determine the amount of laundry load on the basis of at least said fourth value.

Preferably, the electronic control circuit is further configured to control the electric motor so that said prefixed reference speed profile further comprises a deceleration ramp wherein said drum is decelerated from said high speed to said low speed; said constant speed phase being performed immediately after said acceleration ramp) and immediately before said deceleration ramp.

Preferably, the electronic control circuit is further configured to calculate said fourth value by performing said integral function with respect to said first torque values subtracted of said the third value.

Preferably, said electronic control circuit is further configured to calculate said fourth value according to the following equation:

$$\text{Torque_int}=[\Sigma_{i=1}^{N}(Ti-TU)]*\Delta ta$$

wherein $T_i$ are the torque values sampled during said acceleration ramp at instants i, N is the number of torque values sampled during said acceleration ramp, TU is the average torque calculated during said constant speed phase, Δta is the first sample time.

Preferably, said fourth value is calculated according to the following equation:

$$\text{Torque_int}=[(\Sigma_{i=1}^{N}Ti)-(TU*N))]*\Delta ta$$

wherein $T_i$ are the torque values sampled during said acceleration ramp, N is the number of torque values sampled during said acceleration ramp, TU is the average torque calculated during said constant speed phase, Δta is the first sample time.

Preferably, said electronic control circuit is further configured to calculate a load index value based on said fourth value; and determine the amount of the laundry load based on said index value.

Preferably, the load index value is determined based on the following equation IDX=A1*Torque_int; wherein A1 is a constant parameter experimentally calculated and Torque_int is said fourth value.

Preferably, said reference speed profile comprises a sequence of drum speed commutations, wherein each speed commutation comprises said acceleration ramp, said deceleration ramp and said constant speed phase; for each of said speed commutations, the said electronic control circuit is further configured to: sample said first torque values generated by said motor during said acceleration ramp according to said first sample time, sample said second torque values generated by said motor during said constant speed phase according to said second sample time, calculating said third value, which is indicative of an average torque being calculated, in turn, on the basis of said second torque values, determine said fourth value by performing an integral function with respect to said first torque values and the third value, calculate a fifth value which is indicative of the arithmetic mean of said fourth values; determine the amount of laundry load on the basis of differential values, calculated by subtracting said fifth value from said fourth values.

Preferably, said fourth value is determined by performing said integral function with respect to said first torque values subtracted of said the third value.

Preferably said fifth value is calculated according to the following equation:

$$(1/W)*[\Sigma_{k=1}^{W}\text{Torque_int}(k)]$$

Wherein W is the number of speed commutations, Torque_int(k) are the fourth values associated with the respective commutation phases.

Preferably said differential values are calculated according to the following equation:

$$\text{Torque_diff}(k)=\text{Torque_int}(k)-(1/W)*[\Sigma_{k=1}^{W}\text{Torque_int}(k)]$$

Wherein W is the number of speed commutations. Torque_int(k) are fourth values associated with the commutation phases SCP(k).

Preferably, said electronic control circuit is further configured to determine a load index value based on said fourth values and said differential values; determine the amount of the laundry load based on said index value.

Preferably, said electronic control circuit is further configured to compare said laundry load index with one or more prefixed thresholds associated with respective amounts of laundry, and determine the laundry amount based on the comparison results.

Preferably, said second sample time of said second torque values generated by said electric motor during said constant speed phase is comprised between about $0.1*10^{-3}$ s and about $50*10^{-3}$ s.

Preferably, said second sample time of said second torque values generated by said electric motor during said constant speed phase is about $10*10^{-3}$ s.

Preferably, said first sample time of said first torque values generated by said electric motor during said acceleration ramp is comprised between about $0.1*10^{-3}$ s and $20*10^{-3}$ s.

Preferably, said first sample time of said first torque values generated by said motor during said acceleration ramp is about $10*10^{-3}$ s.

Preferably, said constant speed phase has a duration of a prefixed time corresponding about the time spent by said drum to perform a prefixed number of whole revolutions at said high speed.

Preferably, said prefixed time corresponds to the time spent by the drum to perform two whole revolutions at said high speed.

According to an alternative embodiment of the present invention, it is provided a method for determining a laundry load of a laundry treating machine, wherein said laundry treating machine comprises an outer casing, a treating group which is placed inside said outer casing and comprises, in turn, a rotatable drum structured for housing the laundry to be treated, the laundry treating machine is further provided with an electric motor for rotating the drum and a motor controller which is configured to control said motor and comprises a power inverter device, which is configured to drive said motor according to a motor mode and a generator mode, and energy storage means, which are electrically associated with said power inverter device and are designed to be charged by a voltage generated by said motor when the motor operates in said generator mode; said method being characterized in comprising the steps of controlling said drum by the motor in order to cause the motor to operate in said generator mode, determining first values which are indicative of the voltages across said energy storage means when the motor operates in generator mode; determining a maximum voltage value based on the biggest value of said determined first values; determining the amount of laundry load on the basis of said maximum voltage value.

Preferably, in said motor mode, said motor accelerates said drum or maintains the drum at determined speed, in said generator mode, said motor brakes the drum in order to decelerate said drum so as to reduce its drum speed, the method comprises the steps of controlling said drum by the motor in order to cause the drum to perform one or more acceleration and deceleration ramps, and determine said first values during said one or more deceleration ramps.

Preferably, the method comprises the steps of determining second values which are indicative of a first motor parameter associated with the torques generated by said motor during said one or more acceleration ramps, determining third values based on said second values by implementing an approximate mathematical integral functions; determining a fourth value based on said third values; the method further comprises the step of determining the amount of load on the basis of said maximum voltage value and said fourth value.

Preferably, the method comprises the steps of controlling the speed of said drum by the motor in order to maintain the rotational speed of the drum at a determined reference speed for a determined first time; measuring fifth values which are indicative of said first motor parameter associated with the torques provided to said drum by the motor during said first time; calculating a sixth value on the basis of said fifth values; said sixth values being indicative of the friction to which said washing group is subjected, calculating seventh values on the basis of said second values and said sixth values, said seventh values being indicative of the torque that said motor provides to the drum without frictions during acceleration ramp; the method comprising the step of determining said third values by implementing said approximate mathematical integral functions of said seventh values and of the time of said acceleration ramp.

Preferably, the method further comprises the steps of determining a load index value based on said maximum voltage value; determining the amount of the laundry load based on said index value.

Preferably, the method further comprises the steps of determining a load index value based on said fourth value and said maximum voltage value; determining the amount of the laundry load based on said index value.

Preferably, said fifth values are the motor torque values measured during said first time; said second values are the motor torques measured during the acceleration ramps; said sixth value is an average motor torque which is calculated by performing a mean of said motor torque values; said seventh values correspond to filtered torques values; said method comprising the step of calculating said filtered torques values by subtracting said average torque value to said motor torque values measured during the acceleration ramps.

Preferably, said approximate mathematical integral functions corresponds to summation calculus; the method comprising the step of determining said third values by implementing the following equation:

$$Intq(i)=\Sigma_{j=1}^{N}\Delta\text{time}*Tfam(j)$$

wherein: Tfam(j) are said filtered torque values; Intq(i)) is the third value, N is the number of the determined filtered torque values Tfam(j), and the parameter i indicates the performed ramps.

Preferably, the method further comprises the step of calculating said fourth value corresponding to an average rising torque value by implementing the following equation:

$$AR_T=(1/M)*\Sigma_{i=1}^{M}Intq(i)$$

wherein: M represents the number of the rinsing ramps.

Preferably, the method comprises the steps of: repeatedly determining the voltage across said energy storage means during said first time, determining an average tension value based on said determined voltages, determining a maximum voltage value among said determined voltages, wherein maximum voltage value corresponds to the maximum voltage peak of said determined voltages compared to said average tension value, calculating overshoot tension values by subtracting said average tension value from said maximum voltage values, determining said maximum voltage value based on said overshoot tension values.

Preferably said load index value is determined by implementing the following equation:

$$\text{IDX}=K1*AR_T+K2*VCMM$$

wherein IDX is said load index value, K1 and K2 are constant parameters experimentally calculated, AR_T is the fourth value corresponding to said average rising torque value, and VCMM is said maximum voltage value.

Preferably, said fifth values are the electrical power values measured during said first time; said second values are the electrical power values measured during the acceleration ramps; said sixth value is an average electrical power which is calculated by performing a mean of said electrical power values measured during said first time, said seventh values correspond to filtered electrical power; said method comprising the step of calculating said filtered electrical power by subtracting said average electrical power to said electrical power values measured during the acceleration ramps.

Preferably, said approximate mathematical integral functions corresponds to summation calculus; the method further comprises the step determining said third values by implementing the following equation:

$$InE(i)=\Sigma_{j=1}^{N}\Delta\text{time}*Epf(j)$$

wherein InE(i)) is the third value, N is the number of the determined filtered electrical power values EPf(j), and the parameter i indicates the performed ramps.

Preferably, the method comprises the step of calculating said fourth value corresponding to an average electrical power by implementing the following equation:

$$AVGP=\left(\frac{1}{M}\right)*\sum_{i=1}^{M}InE(i)$$

wherein: M represents the number of the performed ramps.

Preferably, said load index value is determined by implementing the following equation:

$$\text{IDX}=K3*\text{AVG}P+K4*VCMM$$

wherein K3 and K4 are memorized constant parameters experimentally calculated, AVGP is the fourth value corresponding to said average electrical power, and VCMM is said maximum voltage value.

Preferably, said fifth values are the mechanical power values measured during said first time; said second values are the mechanical power values measured during the acceleration ramps; said sixth value is an average mechanical power which is calculated by performing a mean of said mechanical power values measured during said first time, said seventh values correspond to filtered mechanical power, said method further comprising the step of calculating said filtered mechanical power by subtracting said average mechanical power to said mechanical power values measured during the acceleration ramps.

Preferably, said approximate mathematical integral functions corresponds to summation calculus; the method comprising the step of determining said third values by implementing the following equation:

$$InM(i)=\Sigma_{j=1}^{N}\Delta\text{time}*MPf(j)$$

wherein MPf(j) is determined filtered mechanical power values, InM(i)) is the third value, N is the number of the determined filtered mechanical power, and the parameter i indicates the performed ramps.

Preferably, the method comprises the step of calculating said fourth value corresponding to an average mechanical power by implementing the following equation:

$$AVGM=\left(\frac{1}{M}\right)*\sum_{i=1}^{M}InM(i)$$

wherein: M represents the number of the rinsing ramps.

Preferably, said load index value is determined by implementing the following equation:

$$\text{IDX}=K5*\text{AVG}M+K6*VCMM$$

wherein K5 and K6 are memorized constant parameters, AVGM is the fourth value corresponding to said average mechanical power, and VCMM is said maximum voltage value.

Preferably, during said acceleration ramp, the speed of said drum is varied from a determined first target speed to a determined second target speed, and vice versa, during the deceleration ramp the speed of said drum is varied from said second target speed to said first target speed.

Preferably, said reference speed of the drum is comprised in the range from 30 to 80 RPM, said first target rotational speed is comprised in the range from 30 to 50 RPM, said second target rotational speed is comprised in the range from 70 to 90 RPM.

Preferably, the method comprises the step of comparing said laundry load index with one or more thresholds associated with corresponding amount of laundry load, and determine the laundry amount based on the comparison results.

Preferably, said energy storage means comprises a buck capacitor circuit or one or more batteries.

Said alternative embodiment further relates to a laundry treating machine comprising an outer casing, a treating group which is placed inside said outer casing and comprises, in turn, a rotatable drum structured for housing the laundry to be treated, an electric motor for rotating the drum electronic control means which are configured to control said motor and comprises a power inverter device, which is configured to drive said motor according to a motor mode and a generator mode and energy storage means, which are electrically associated with said power inverter device and are designed to be charged by a voltage generated by said motor when the motor operates in said generator mode; said laundry treating machine being characterized in that said electronic control means are further configured to: control said drum by the motor in order to cause said motor to operate in said generator mode; determine first values which are indicative of the voltages across said capacitor circuit when said motor operates in said generator mode; determine a maximum voltage value based on the biggest value of said determined first values; determine the amount of laundry load on the basis of said maximum voltage value.

Preferably, the electronic control means are further configured to control said motor in order to accelerate said drum or maintains the drum at determined speed in said motor mode, and brakes the drum in order to decelerate said drum so as to reduce its drum speed, said electronic control means are further configured to control the motor in order to cause the drum to perform one or more acceleration and deceleration ramps; and determine said first values during said one or more deceleration ramps.

Preferably, said electronic control means are further configured in order to determine second values, which are indicative of a first motor parameter associated with the torques generated by said motor during said one or more acceleration ramps; determine third values based on said second values by implementing an approximate mathematical integral functions; determine a fourth value based on said third values; determining the amount of load on the basis of said maximum voltage value and said fourth value.

Preferably, said electronic control means are further configured to control the speed of said drum by the motor in order to maintain the rotational speed of the drum at a determined reference speed for a determined first time; measure fifth values which are indicative of said first motor parameter associated with the torques provided to said drum by the motor during said first time; calculate a sixth value on the basis of said fifth values; said sixth values being indicative of the friction to which said washing group is subjected, calculate seventh values on the basis of said second values and said sixth values, said seventh values being indicative of the torque that said motor provides to the drum without frictions during acceleration ramp; said electronic control means are further configured determine said third values by implementing said approximate mathematical integral functions of said seventh values and of the time of said acceleration ramp.

Preferably, said electronic control means are further configured to determine a load index value based on said maximum voltage value and determine the amount of the laundry load based on said index value.

Preferably, said electronic control means are further configured to determine a load index value based on said fourth value and said maximum voltage value and determine the amount of the laundry load based on said index value.

Preferably, said fifth values are the motor torque values measured during said first time; said second values are the motor torques measured during the acceleration ramps; said sixth value is an average motor torque which is calculated by performing a mean of said motor torque values; said seventh values correspond to filtered torques values; said electronic control means are further configured to calculate said filtered torques values by subtracting said average torque value to said motor torque values measured during the acceleration ramps.

Preferably, said approximate mathematical integral functions corresponds to summation calculus; the method comprising the step of determining said third values by implementing the following equation:

$$Intq(i)=\Sigma_{j=1}^{N}\Delta\text{time}*Tfam(j)$$

wherein: Tfam(j) are said filtered torque values; Intq(i)) is the third value, N is the number of the determined filtered torque values Tfam(j), and the parameter i indicates the performed ramps.

Preferably, said electronic control means are further configured to calculate said fourth value corresponding to an average rising torque value by implementing the following equation:

$$\text{AR_T}=\left(\frac{1}{M}\right)*\sum_{i=1}^{M}Intq(i)$$

wherein: M represents the number of the rinsing ramps.

Preferably, said electronic control means are further configured to repeatedly determine the voltage across said energy storage means during said first time, determine an average tension value based on said determined voltages, determine a maximum voltage value among said determined voltages, wherein maximum voltage value corresponds to the maximum voltage peak of said determined voltages compared to said average tension value, calculate overshoot tension values by subtracting said average tension value from said maximum voltage values, determine said maximum voltage value based on said overshoot tension values.

Preferably said load index value is determined by implementing the following equation:

$$\text{IDX}=K1*AR_T+K2*VCMM$$

wherein IDX is said load index value, K1 and K2 are constant parameters experimentally calculated, AR_T is the fourth value corresponding to said average rising torque value, and VCMM is said maximum voltage value.

Preferably, said fifth values are the electrical power values measured during said first time; said second values are the electrical power values measured during the acceleration ramps; said sixth value is an average electrical power which is calculated by performing a mean of said electrical power values measured during said first time, said seventh values correspond to filtered electrical power, said electronic control means are further configured to calculate said filtered electrical power by subtracting said average electrical power to said electrical power values measured during the acceleration ramps.

Preferably, said approximate mathematical integral functions corresponds to summation calculus; the method further comprises the step determining said third values by implementing the following equation:

$$InE(i)=\Sigma_{j=1}^{N}\Delta\text{time}*EPf(j)$$

wherein InE(i)) is the third value, N is the number of the determined filtered electrical power values EPf(j), and the parameter i indicates the performed ramps.

Preferably, the said electronic control means are further configured to calculate said fourth value corresponding to an average electrical power by implementing the following equation:

$$AVGP=\left(\frac{1}{M}\right)*\sum_{i=1}^{M}InE(i)$$

wherein: M represents the number of the rinsing ramps.

Preferably, said load index value is determined by implementing the following equation:

$$\text{IDX}=K3*\text{AVG}P+K4*VCMM$$

wherein K3 and K4 are memorized constant parameters experimentally calculated, AVGP is the fourth value corresponding to said average electrical power, and VCMM is said maximum voltage value.

Preferably, said fifth values are the mechanical power values measured during said first time; said second values are the mechanical power values measured during the acceleration ramps; said sixth value is an average mechanical power which is calculated by performing a mean of said mechanical power values measured during said first time, said seventh values correspond to filtered mechanical power; said electronic control means are further configured to calculate said filtered mechanical power by subtracting said average mechanical power to said mechanical power values measured during the acceleration ramps.

Preferably, said approximate mathematical integral functions corresponds to summation calculus; the method comprising the step of determining said third values by implementing the following equation:

$$InM(i)=\Sigma_{j=1}^{N}\Delta\text{time}*MPf(j)$$

wherein MPf(j) is determined filtered mechanical power values, InM(i)) is the third value, N is the number of the determined filtered mechanical power), and the parameter i indicates the performed ramps.

Preferably, said electronic control means are further configured to calculate said fourth value corresponding to an average mechanical power by implementing the following equation:

$$AVGM=\left(\frac{1}{M}\right)*\sum_{i=1}^{M}InM(i)$$

wherein: M represents the number of the rinsing ramps.

Preferably, said load index value is determined by implementing the following equation:

$$\text{IDX}=K5*\text{AVG}M+K6*VCMM$$

wherein K5 and K6 are memorized constant parameters, AVGM is the fourth value corresponding to said average mechanical power, and VCMM is said maximum voltage value.

Preferably, during said acceleration ramp, the speed of said drum is varied from a determined first target speed to a determined second target speed, and vice versa, during the deceleration ramp the speed of said drum is varied from said second target speed to said first target speed.

Preferably, said reference speed of the drum is comprised in the range from 30 to 80 RPM, said first target rotational speed is comprised in the range from 30 to 50 RPM, said second target rotational speed is comprised in the range from 70 to 90 RPM.

Preferably, said electronic control means are further configured to compare said laundry load index with one or more thresholds associated with corresponding amount of laundry load, and determine the laundry amount based on the comparison results.

Preferably, said energy storage means comprises a buck capacitor circuit or one or more batteries.

BRIEF DESCRIPTION OF THE DRAWINGS

Further characteristics and advantages of the present invention will be highlighted in greater detail in the following detailed description of some of its preferred embodiments, provided with reference to the enclosed drawings. In the drawings, corresponding characteristics and/or components are identified by the same reference numbers. In particular:

FIG. 5 illustrates a chart of the reference speed profile and the torque provided to the drum by the motor when the drum rotates according to the reference speed profile; whereas

DETAILED DESCRIPTION OF THE INVENTION

The method of the present invention has proved to be particularly advantageous because allowing to quickly determine the amount of laundry load without additional electrical components in the machine, by using the motor torques samples, according to a convenient sample time, both during acceleration ramp and during a speed constant phase of the drum, following the acceleration ramp.

Figure 1:
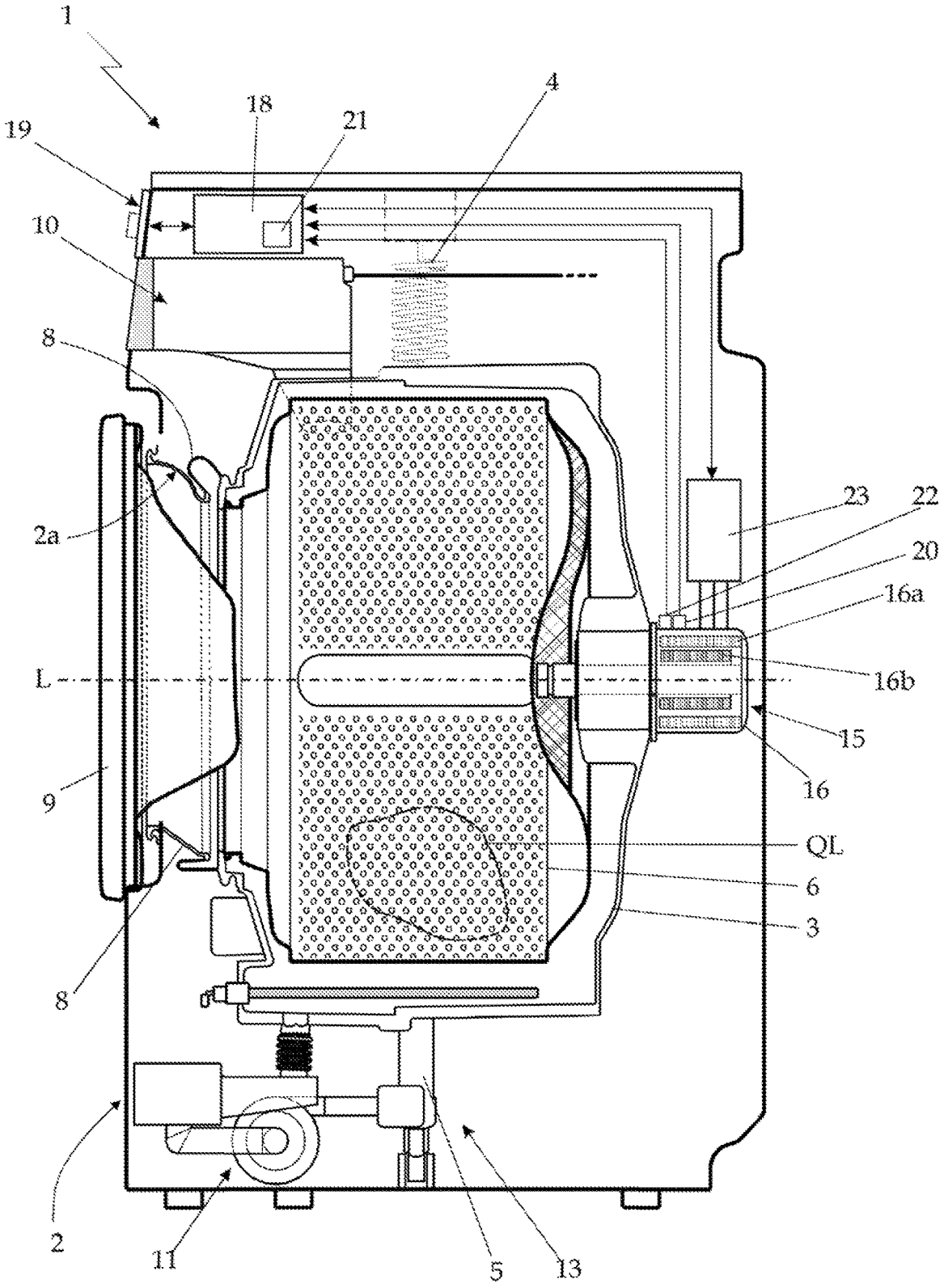
FIG. 1 shows a schematic cross section, with parts removed for clarity, of a laundry washing machine made according to the present invention.

With reference to FIG. 1, number I indicates as a whole a laundry washing machine comprising a preferably, though not necessarily, parallelepiped-shaped outer box casing 2 resting on the floor; a laundry washing group which is placed within said casing 2 and comprises preferably in turn a substantially bell-shaped laundry washing tub 3 suspended in floating manner inside casing 2 via a suspension system comprising a number of coil springs 4 (only one illustrated in FIG. 1) preferably, though not necessarily, combined with one or more vibration dampers 5 (only one shown in FIG. 1) and a substantially bell-shaped rotating drum 6 for housing the laundry QL to be washed and/or dried, and which is fixed in axially rotating manner inside washing tub 3 for rotating about a longitudinal axis L.

As can be appreciated, the present invention can be conveniently applied to any kind of laundry treatment machines, like for example laundry washing machine (washing machine) and washing and drying machines (called also washer-driers) or laundry drying machines (called also drier), wherein one or more steps of introducing water and/or steam and/or hot/cool air inside a laundry tub is required.

In the example illustrated in FIG. 1, the laundry washing machine 1 is a front loading laundry washing machine. The present invention has proved to be particularly successful when applied to front loading laundry washing machines. It should in any case be understood that the present invention is not limited to this type of application. On the contrary, the present invention can be usefully applied to different types of laundry washing machines, for example top loading laundry washing machines or top loading laundry washing and drying machines.

According to the exemplary embodiment, the laundry washing tub 3 is suspended in floating manner inside the casing 2, with the front opening of the laundry washing tub 3 directly faced to a laundry loading and unloading opening 2*a* formed in the front face of casing 2. Rotating drum 6, in turn, is housed into laundry washing tub 3 so as that its longitudinal axis L is preferably oriented substantially horizontally, and coincides with the longitudinal axis of laundry washing tub 3. It is understood that in alternative embodiment not shown, rotation axis L may be vertical or inclined.

In the exemplary embodiment illustrated in FIG. 1, the front opening of washing tub 3 is connected to opening 2*a* on the front face of casing 2 via a cylindrical elastic-deformable bellows 8, and the washing machine 1 is also provided with a door 9 which is preferably hinged to the front face of casing 2 to rotate to and from a rest position (illustrated in FIG. 1) in which door 9 closes opening 2*a* of casing 2 to seal washing tub 3.

As illustrated in the exemplary embodiment of FIG. 1, the laundry washing machine 1 may preferably, although not necessary, comprise a liquid supply assembly (not illustrated) designed for supplying water to the washing machine 1 to use in washing laundry during a cycle of operation. For example the liquid supply assembly may comprise a source of water, such as a household water supply and may include one or more conducts and electric-controlled valves for controlling the flow of water directed preferably towards the laundry washing tub 3 and rotating drum 6 across the conducts.

The laundry washing machine 1 may preferably, although not necessary, comprise a detergent dispensing apparatus 10 (only partially illustrated in FIG. 1) for dispensing detergent to the drum 6/tub 3 to be used in washing the laundry according to a selected washing program. The detergent dispensing apparatus 10 may comprise a dispenser which may be a single use dispenser, a bulk dispenser or a combination of a single and bulk dispenser. Regardless of the type of dispenser used, the dispenser may be configured to dispense detergent directly to the laundry washing tub 3 or mixed with water from the detergent dispensing apparatus 10 through a dispensing outlet conduit (not illustrated).

As illustrated in the exemplary embodiment of FIG. 1, the laundry washing machine 1 may further comprise a drain apparatus 13 which is designed to drain liquid from the washing machine 1, and preferably, although not necessarily, a heating system (not illustrated) for heating the liquid (water) and/or air to be supplied to the tub 3.

According to a preferred embodiment illustrated in FIG. 1, the laundry washing machine 1 is further provided with a drive apparatus 15, which is designed to rotate the drum 6 within the tub 3. The drive apparatus 15 may comprise an electric motor 16 for rotating the drum 6 around the axis L.

According to the exemplary embodiment illustrated in FIG. 1, the electric motor 16 may be directly coupled with the drum 6 through a drive shaft to rotate the drum 6 around the rotational axis L. Alternately, the motor 16 may be coupled to the drum 6 through a belt (not illustrated) and a drive shaft to rotate the drum 6, as is known in the art. The electric motor 16 may be a three-phases or bi-phases motor, having a stator 16*a* and a rotor 16*b*. A non-limiting example of electric motor 16 may be a permanently excited synchronous motor or an asynchronous motor or a brushless direct current motor or an induction motor or any similar motor. The electric motor 16 is designed to rotationally drive the drum 6 at various speeds in either rotational direction.

Figure 2:
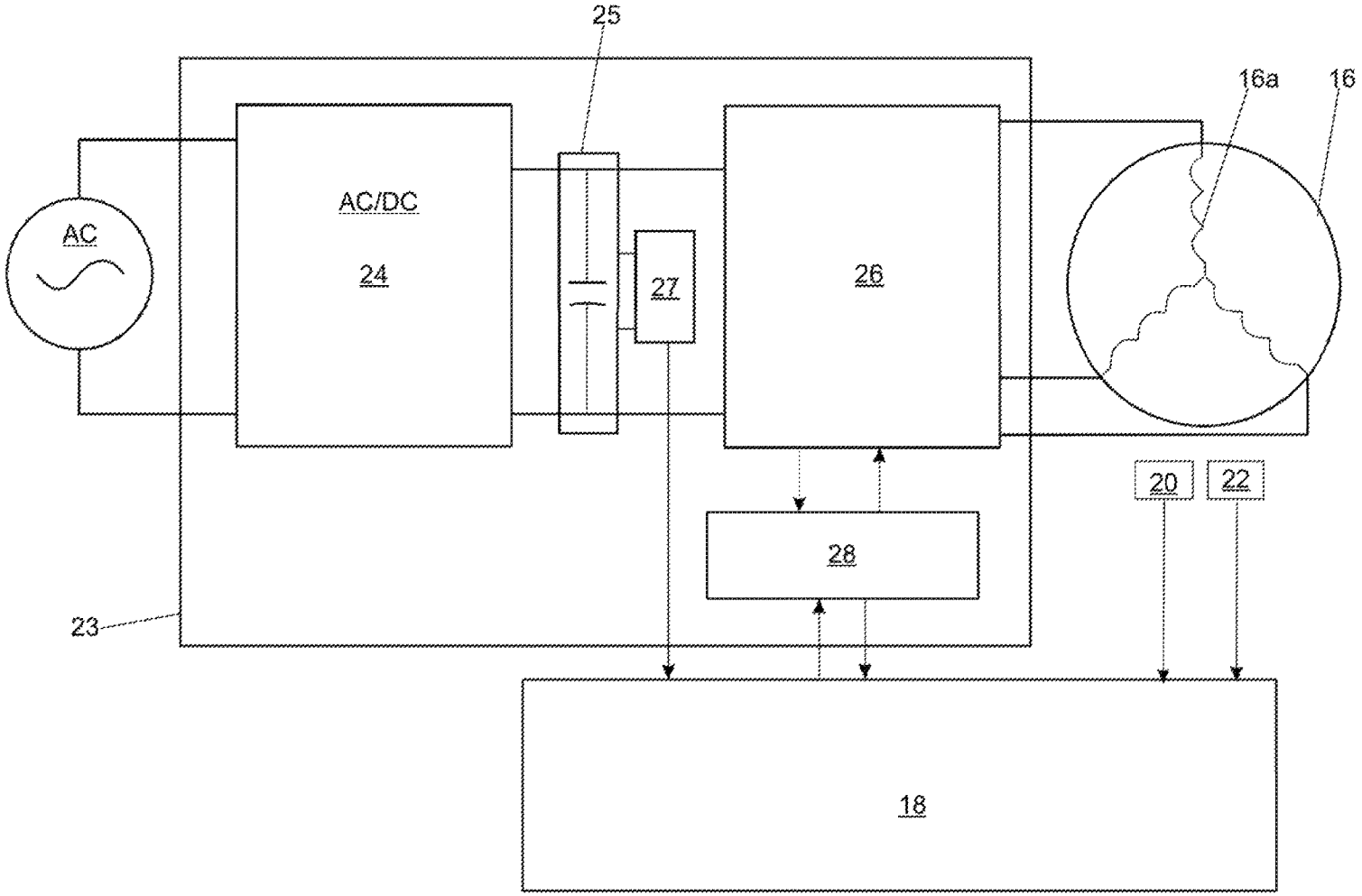
FIG. 2 is a schematic of a control system of the circuit arrangement of the laundry washing machine illustrated in FIG. 1.

According to a preferred embodiment illustrated in FIGS. 1 and 2, the laundry washing machine 1 is further provided with a control system for controlling the operation of the laundry washing machine 1 in order to perform one or more laundry washing/drying programs selected by users. The control system may be provided with a electric/electronic control circuit 18 located within the casing 2 and a user interface 19, that is electrically coupled with the control circuit 18. The user interface 19 may include a control panel with one or more displays, touch screens dials, knobs, switches, and the like for communicating with users, such as to receive input and provide output. An user may enter in the user interface 19 different types of information such for example, washing cycle parameters, washing cycle programs, etc. . . . .

The control circuit 18 may comprise one or more controllers configured to control the operating of the machine and any of the electric/electronic components/circuit, boards of the laundry washing machine 1 according to the method hereinafter disclosed. Preferably, although not necessarily, the control circuit 18 may comprise one or more microprocessor-based controller configured to implement control software and/or sends/receives one or more electrical signals to/from each of the various electric/electronic components/circuits/boards to effect the control software. The control circuit 18 may be electrically coupled with one or more components of the laundry washing machine 1 for communicating with and controlling the operation of the components in order to perform a washing program. The control circuit 18 may also be coupled with one or more sensors provided in one or more of the systems of the laundry washing machine 1 to receive input from the sensors.

According to the present invention, non-limiting examples of sensors which may be electrically coupled with the control circuit 18 may preferably, although not necessary, comprise, a motor torque sensor 20 which is configured to provide a torque output signal being indicative of the torque generated by the electric motor 16, which corresponds about to the torque applied to the drum 6 by said motor 16.

It is understood that the motor torque sensor 20 provides a signal value being a function of the inertia of the rotating drum 6 and the laundry load QL. The motor torque sensor 20 may also comprise a motor controller or similar data output on the motor 16 that provides data communication with the motor 16 and outputs motor characteristic information, generally in the form of an analog or digital signal, to the control circuit 18 that is indicative of the applied torque.

The control circuit 18 may use the motor characteristic information to determine the torque applied by the motor 16 using software that may be stored in a memory device 21. Specifically, the motor torque sensor 20 may be any suitable sensor, such as a voltage or current sensor, for outputting a current or voltage signal indicative of the current or voltage supplied to the motor 16 to determine the torque applied by the motor 16. Additionally, the motor torque sensor 20 may be a physical sensor or may be integrated with the motor and combined with the capability of the control circuit 18, may function as a sensor. For example, motor characteristics, such as current, voltage, torque etc., may be processed such that the data provides information in the same manner as a separate physical sensor.

According to the preferred embodiment illustrated in FIG. 1, the laundry washing machine 1 may preferably comprise a speed sensor 22 which may be positioned in any suitable location for detecting and providing a speed output indicative of a rotational speed of the drum 6.

Such a speed sensor 22 may be any suitable speed sensor capable of providing an output indicative of the speed of the drum 16. It is also contemplated that the rotational speed of the drum 6 may also be determined based on a motor speed; thus, the speed sensor 22 may include a motor speed sensor for determining a speed output indicative of the rotational speed of the motor 16. The motor speed sensor may be a separate component, or may be integrated directly into the motor 16. Regardless of the type of speed sensor employed, or the coupling of the drum 6 with the motor 16, the speed sensor 22 may be configured to cause the control circuit 18 to determine the rotational speed of the drum 6 from the rotational speed of the motor 16. The above described washing machine 1 may be used to implement one or more embodiments of the invention. The embodiments of the method of the invention may be used to determine the amount of laundry load QL in the drum 6.

The control system may be further provided with a motor controller 23 which is electrically coupled with the control circuit 18 and with the motor 16 to control the later according to the washing program to be performed.

According to a preferred embodiment illustrated in FIG. 2, the motor controller 23 may comprise a rectifying unit 24 for converting an AC power source into a DC voltage and outputting the converted DC voltage, and an energy storage circuit which, in the illustrated example, comprise a DC or bulk capacitor circuit 25 for smoothing the DC voltage which was rectified by the rectifying unit 24. However, it is understood that the present invention is not limited to the bulk capacitor circuit 25. On the contrary, motor controller 23 may comprise, in alternative, or in addition to, the bulk capacitor circuit 25, one or more electrical batteries (not illustrated) or similar apparatus configured to storage the electrical energy. It follows that the operations concerning the bulk capacitor circuit 25, performed by the method according to the next description, may be performed likewise for the electrical batteries.

The motor controller 23 further comprise a power inverter device 26 for driving the motor 16 by means of the DC voltage, which was transferred by the rectifying unit 24. The motor controller 23 may further comprise a voltage-sensing unit 27 for sensing/measuring the voltage of the energy storage circuit (which in the illustrated example is the DC/bulk capacitor circuit 25), during the operating of the motor 16, and provide to the control circuit 18 a sensed voltage generated due to the sensed results.

The motor controller 23 may further comprise a control module 28, i.e. a microcomputer which controls the power inverter device 26 so as to pilot the motor 16 based on commands provided by the control circuit 18.

A detailed description of other components present in the laundry washing machine 1 will be omitted because it is considered to be unnecessary for the present invention.

Figure 3:
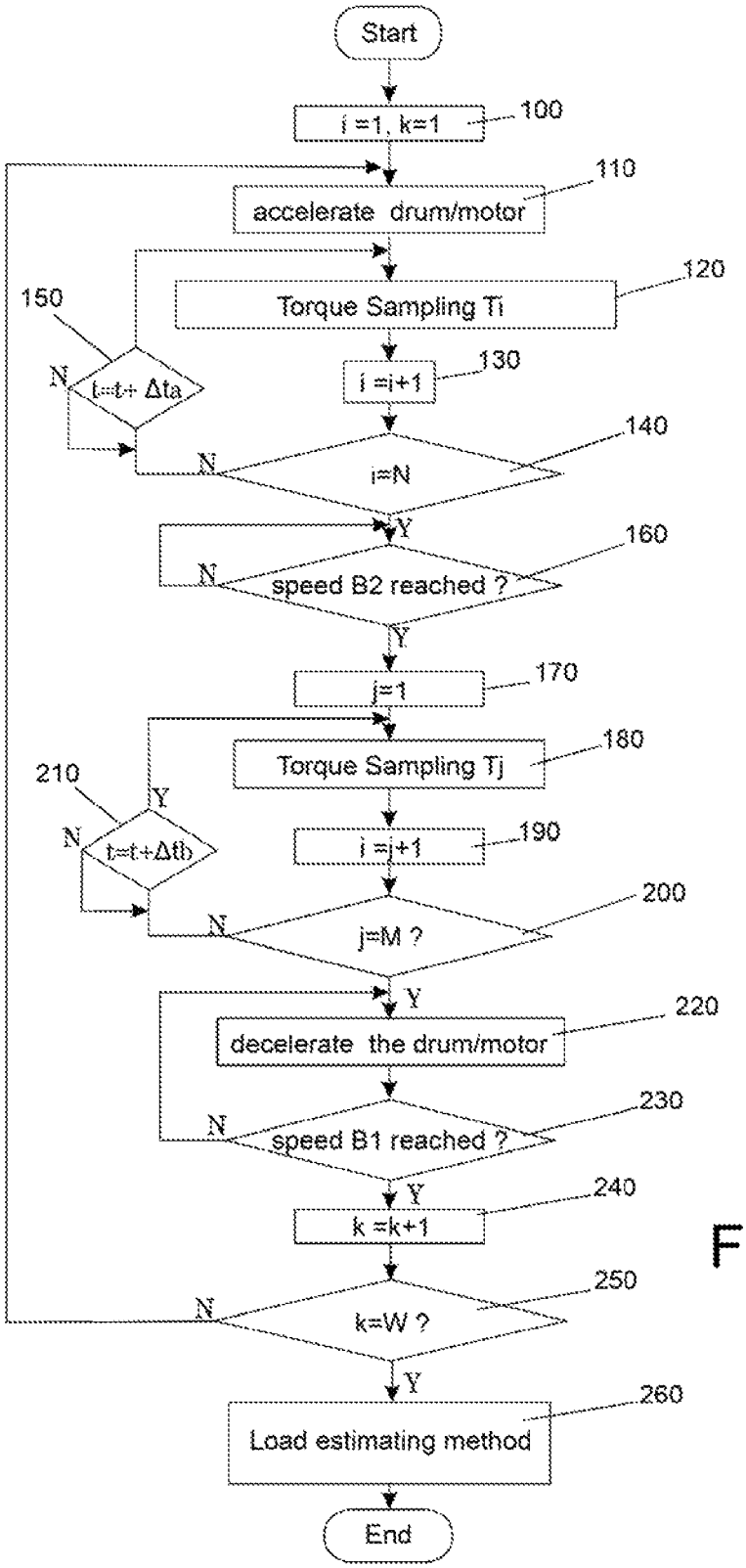
FIG. 3 is a flow chart illustrating the operations of the motor for determining the amount of laundry load in the rotating drum, in accordance with the present invention.
Figure 4:
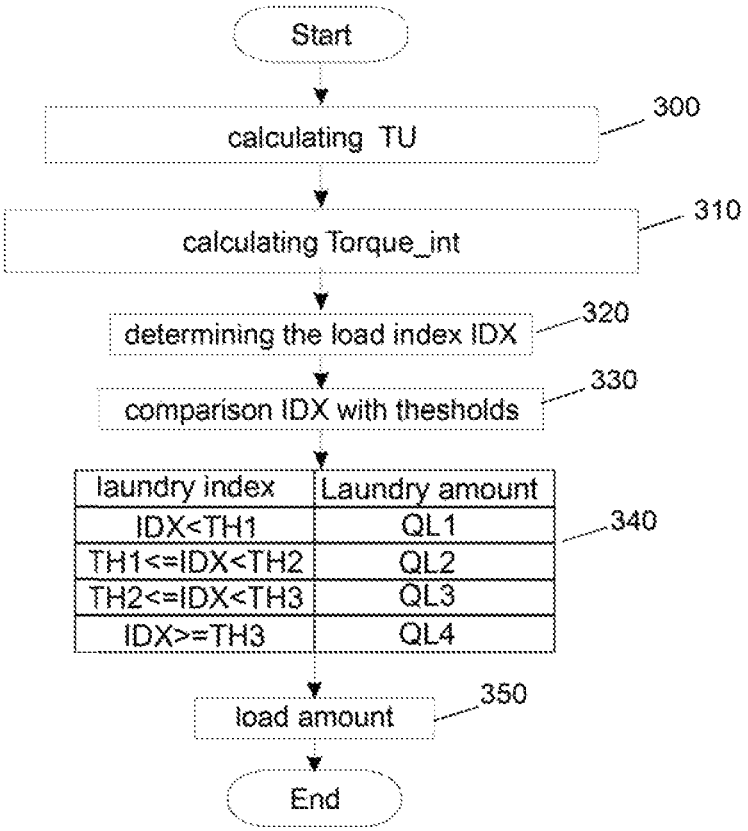
FIG. 4 is a flow chart illustrating the steps performed by the method for determining the amount of laundry load in the rotating drum, in accordance with a first embodiment of the present invention.

Referring now to FIGS. 3 and 4, flow charts of a method for determining the amount of laundry load QL in the drum 6 are illustrated.

The sequence of steps illustrated for this method is for illustrative purposes only, and is not meant to limit the method in any way as it is understood that the steps may proceed in a different logical order or additional or intervening steps may be included without detracting from the invention. The method may be implemented in any suitable manner, such as automatically, as a stand-alone phase or cycle of operation or as a phase of an operation cycle of the washing machine 1.

Before explaining the method, it is hereby provided a list of symbols/signs used in the present description and their meaning in order to improve the clarity of the present invention.

SCP(k)=speed commutation phase;

Ra(k)=acceleration ramp phase;

Rd(k)=deceleration ramp phase;

S(k)=constant speed phase;

Δts=duration of the constant speed phase S(k);

B1=first rotational drum speed;

B2=second rotational drum speed;

k=commutation counter;

i=torque index;

j=torque index;

Ti=samples of motor torque during the acceleration ramp Ra(k) (k comprised between 1 and N);

N=number of motor torque samples during the acceleration ramp Ra(k);

Tj=sample of motor torque during the constant speed phase S(k);

M=number of motor torque samples during the constant speed phase S(k);

RN=number of revolutions of the drum;

Δta=torque sample time during the acceleration ramp Ra(k);

Δtb=torque sample time during the constant speed phase S(k);

W=number of speed commutation phases to be performed during a reference speed profile;

TU=average torque value;

Torque_int=integral function with respect to said the torque values Ti and preferably, with TU;

Torque_diff=differential values.

FIG. 3 is a flow chart comprising some operation of the motor 16 for determining the amount of laundry load QL of the laundry washing machine 1 in accordance with one embodiment of the present invention, whereas FIG. 4 is a flow chart illustrating remaining operations performed by the method for determining the amount of laundry load QL of a laundry washing machine 1 in accordance with an embodiment of the present invention.

More in detail, the flow chart in FIG. 3 comprises the steps performed by the method to drive the motor 16 in order to rotate the drum 6 according to a prefixed reference speed profile (for example performed as in FIG. 5), whereas the flow chart of FIG. 4 comprises the steps implemented by the method to calculate the amount of laundry load QL in the drum 6, when the speed of the drum 6 is varied according to said reference speed profile.

It should in any case be understood that the present invention is not limited to the reference speed profile corresponding to the "drum" speed, but according to a different embodiment it may be envisaged to use, in alternative, a reference speed profile corresponding to the "motor" speed.

With reference to the exemplary embodiment illustrated in FIG. 5, the prefixed reference speed profile may comprise one or more speed variations of the drum 6, hereinafter called "speed commutations phases" SCP(k) to which the following description will make explicit reference without thereby losing generality. Each speed commutation phase SCP(k) comprises: an acceleration ramp phase Ra(k), a deceleration ramp phase Rd(k), and a constant speed phase S(k) which is located between the acceleration ramp Ra(k) and the corresponding deceleration ramp Rd(k).

Preferably, the rotational speed of the drum 6 during the acceleration Ra(k)/deceleration ramps Rd(k) varies between a determined first rotational speed B1 and a second rotational speed B2 which is greater than the first speed, i.e. B2>B1. The reference speed of the drum 6 during the constant speed phase S(k) is maintained approximately at the second rotational speed B2.

According to the preferred embodiment, the number of speed commutation phases SCP(k) of the reference speed profile may be conveniently comprised between one and six commutation phases SCP(k). Preferably, the method may perform four commutation phases SCP(k).

Preferably, during the acceleration ramp phase Ra(k), the motor may operate in a "motor mode", whereas during the deceleration ramp Rd(k) the motor brakes the drum 6 and operates in a "generator mode".

Figure 5:
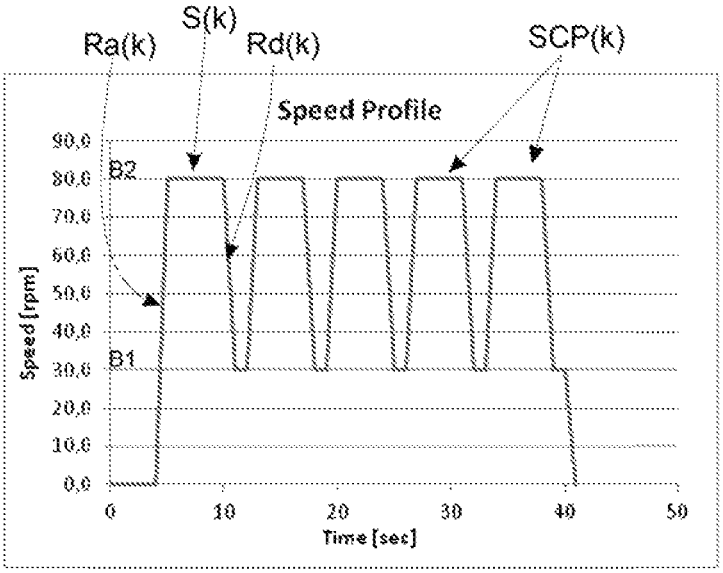

According to the exemplary embodiment illustrated in FIG. 5, the first rotational speed B1 may be preferably comprised in the speed range from about 25 to 35 RPM, preferably 30 RPM, whereas the second rotational speed B2 corresponding to the reference speed may be preferably comprised in the range from about 75 to 85 RPM, preferably 80 RPM.

With reference to FIG. 5, the speed changes of the drum 6 during each speed commutation phase SCP(k) is advantageously equal to the speed changes of the other commutation phases SCP(k), whereas the duration of the constant speed phase S(k) is the prefixed time Δts.

The method starts at the beginning of the laundry washing cycle, with assuming that the user has placed one or more laundry items for treatment within the drum 6, selected laundry washing program through the user interface 19, and started of performing the selected laundry washing program. Moreover, it is assumed that control circuit 18 may preferably have performed a known draining phase/procedure in which the drain apparatus 13 has drained remaining liquid/water present in the washing machine 1.

In detail, the user loads the laundry and then may press start. At the beginning of the cycle, a drain pump, if present, may be preferably activated to drain the remaining water in the washing tub 3; preferably, right after the draining phase, some movements may be performed (without loading water) to detect the amount of laundry. The information extrapolated from the movements may be used for setting some washing cycle parameters and to give some information to the customer, like estimated cycle length and/or the determined amount of laundry.

With reference to the flow chart illustrated in FIG. 3, the control circuit 18 drives the motor 16 by means of the motor controller 23 in order that the speed of the drum 6 tracks the reference speed profile comprising one or more speed commutation phases SCP(k). Non-limiting example of the reference speed profile performed by the method, used with the only aim to improve the understanding of the present invention is illustrated in FIG. 5.

At blocks 100-160 of FIG. 3, the control circuit 18 drives the motor 16 by means of the motor controller 23 in order to preferably perform a number of the sequential speed commutations phases SCP(k) wherein, during each commutation SCP(k), the drum 6 is: accelerated according to the acceleration ramp Ra(k), maintained at the reference speed for the prefixed time Δts and, finally, decelerated according to the deceleration ramp Rd(k).

According to an exemplary embodiment illustrated in FIG. 3 (block 100), the method may preferably comprise the steps of: setting a counter k=1 which is designed to count the speed commutation phases SCP(k), and setting an index i=1 associated with a torque samples Ti during the acceleration ramp Ra(k).

Moreover, the method may further comprise the steps of: accelerating the drum 6 according to the acceleration ramp Ra(k)(block 110) from the first speed B1 to the second speed B2 (block 160).

While the drum 6 is being accelerated, the motor may operate in "motor mode" and the method, i.e. the control circuit 18, performs the steps of: sampling the motor torque Ti (block 120), increasing the index i=i+1 (block 130), and checking if the index i is equal to the prefixed number N (block 140), which is indicative of the maximum number of torque sampling to be performed during the acceleration ramp Ra(i).

If the index i is not equal to the prefixed number N (output N from the block 140), the method performs again, after a prefixed sampling time Δta (block 150), the sampling of the motor torque when the drum 6 is accelerating.

More specifically, according to a preferred embodiment, the control circuit 18 may receive one or more signals from the motor 16 and/or from the motor torque sensor 20 and determines/samples the motor torque Ti based on these electrical signals. Preferably, the signal may comprise electric values indicative of the current supplied to the motor by the inverter device 26.

Vice versa, if the sampling index i is equal to the prefixed number N (output Y from the block 140) the method stops the sampling and preferably continue to accelerate the drum 6 until the drum speed reaches the prefixed second speed B2 (block 160).

It should be understood that present invention is not limited to a prefixed number N. Indeed, alternately, N may be indefinite and the method does not perform the step 140 and the step 150 follows the step 130. The value N may be calculated based on the number of torques values sampled during the acceleration ramp Ra(i) until the drum speed reaches the prefixed second speed B2. In detail, the method may sample the motor torque Ti at prefixed sampling time Δta until the drum speed reaches the prefixed second speed B2 (block 160) and when the latter condition is meet, calculates the number N based on the index i, i.e. N=i.

When the speed of the drum 6 reaches the second speed B2 (Outputs Y from the block 160), the control circuit 18 drives the motor 16 in order to maintain the drum 6 at the reference speed B2 for the prefixed time Δts and, during the latter, samples the motor torques Tj according to a prefixed sample time Δtb.

According to the exemplary embodiment illustrated in FIG. 3, the method may preferably comprise the steps of: setting the index j=1 (block 170), sampling the torque Tj (block 180) according to the sample time Δtb, increasing the index j=j+1 (block 190), checking when the sampling index j reaches a prefixed number M (block 200), which is indicative of the maximum number of torque sampling to be performed during the constant speed phase S(k).

In other words, while the speed of the drum 6 is being maintained at the reference speed 132, i.e. during the time Δts (blocks from 160 to 200), the method may repeatedly determine a value which is indicative of the motor torque Tj.

If the sampling index j is not equal to the prefixed number M (output N from the block 200), the method performs again, after the sampling time Δtb (block 210), the sampling of the motor torque during the constant speed phase S(k).

Vice versa, if the index j is equal to the prefixed number M (output Y from the block 200), the method starts decelerating the drum 6 (block 220) until the drum speed reaches the first speed 131 (block 230). During the deceleration ramp Rd(i), the motor preferably operates in generator mode.

When the control circuit 18 determines that the drum 6 rotates at the first speed B1 (outputs Y from the block 230) and thus the commutation has been completed, the control circuit 18 may increase the commutation counter k=k+1 (block 240).

It should be understood that, again, the present invention is not limited to a prefixed number M. Indeed, alternately, M may be indefinite and the method does not perform the step 200 and the step 210 follows the step 190. Thus, the value M is calculated based on the number of torques values repeatedly sampled during the time Δts. In detail, the method samples the motor torque Tj at prefixed sampling time Δtb until the end of the constant speed phase S(k) (Δts) and calculates the number M based on the index j, i.e. N=j.

Afterwards the method checks if the commutation counter k is equal to a value W, which is the number of speed commutation phases that the method must perform (block 250) in order to determine whether a new speed commutation phase has to be performed.

If not (N output from block 250), the method repeats the same steps disclosed in blocks 110-250, while if yes (outputs Y from block 250), i.e. the commutation counter "k" reaches the value W, the methods performs the load estimating method according to the flow chart illustrated in FIG. 4.

With reference to the flow chart illustrated in FIG. 4, the method determine/calculate a value TU which is indicative of an average torque value calculated according to the motor torque samples Tj (block 300) determined during the constant speed phase S(k) of a speed commutation phase SCP(k).

For example, the value TU may be determined by performing an arithmetic mean of the measured torques values Tj. For example the method may implements the following equation:

$$TU = \left(\frac{1}{M}\right) * \sum_{j=1}^{M} Tj \qquad \text{Equation 1)}$$

Preferably, the value TU may be memorized in the memory device 21. It is understood that average torque value TU is substantially indicative of the torque needed to contrast friction of the washing machine. In detail, friction in washing machine has two sources. One may be called system friction. Because of differences in stiffness, suspension, machine age, bearings, motor temperature, belt tension, and the like, the variation of the system friction can be significantly large between one washing machines and another. A second source of friction corresponds to friction of the laundry on the door and friction on door gasket/bellows 8. These components of friction depend on size of the laundry and its imbalance conditions in the drum 6.

The method further comprises the step of performing an approximate integral calculus (preferably comprising a summation in the example) of the torques values Ti sampled during the acceleration ramp Ra(k) subtracted of the value TU. Preferably the method comprises the step of determining the value Torque_int according to the following equation (block 310):

$$\text{Torque_int}=[\Sigma_{i=1}^{N}(Ti-TU)]*\Delta ta \qquad \text{Equation 2):}$$

It is understood that according to the preferred embodiment of the present invention, the acceleration ramp Ra(k) and the constant speed phase S(k) may be preferably comprised in the same speed commutation phase SCP(k), wherein the constant speed phase S(k) starts directly at the end of the acceleration ramp Ra(k).

According to an alternative embodiment, the value Torque_int is calculated based on the following equation 3) (which replaces the equation 2):

$$\text{Torque_int}=[(\Sigma_{i=1}^{N}Ti)-(TU*N))]*\Delta ta \qquad \text{Equation 3):}$$

According to the alternative embodiment, the method may perform the following steps:

calculating an integral function with respect to the first torque values Ti based on the following equation:

$(\Sigma_{i=1}^{N} Ti)$(integral function with respect to the first torque values $Ti$); Equation 3a):

multiplying the value TU by the number N of torque samples Ti;

$(TU*N)$ Equation 3b):

performing the difference between the value obtained by the equation 3a) and the value obtained by the equation 3b) and multiplying the difference value by prefixed sample time Δta.

According to the preferred embodiment, the method may preferably calculate a laundry load index value IDX which is indicative of the laundry load within the drum 6 based on the value Torque_int (block 320).

In detail, the method may preferably calculate the laundry load index value IDX by implementing the following equation:

$$IDX=A1*Torque_int \quad \text{Equation 4):}$$

Wherein A1 is a constant parameter experimentally calculated (by the Applicant) and preferably memorized in the memory device 21.

Moreover, the method may preferably compare the laundry load index IDX with one or more thresholds Thi (i comprised between 1 and d) associated with respective amount of laundry load QLi and determines/estimates the laundry amount based on the comparison results (block 330).

With reference to the exemplary embodiment illustrated in FIG. 4 (block 340), the method may preferably comprise a number of determined threshold THi, i.e. preferably three thresholds TH1, TH2 and TH3 (i comprised between 1 and d=3). In detail, if the laundry load index IDX is lower than the first threshold TH1, i.e. IDX<TH1, the method determines the first amount QL1 (wherein the amount is a determined weight); whereas if the laundry load index IDX is comprised in the range delimited by a first and second threshold TH1 and TH2, i.e. TH1<=IDX<=TH2 the method determine the second amount QL2; if the laundry load index IDX is comprised in the range delimited by the second and third thresholds TH2 and TH3 the third amount QL3 is determined; whereas if laundry load index IDX is greater that the threshold TH3, the fourth amount QL4 is determined.

It should be understood that the estimated amount of laundry load QLi takes conveniently in to account the values estimated during the speed commutation phases.

After determining the laundry load amount, the method preferably displays such determining/estimated value to the user by the user interface 19 and/or preferably set several parameters of the washing cycle, such as for example, the amount of water/detergent to be loaded, the cycle duration, and other washing parameters, based on the determined laundry amount.

According to the present invention, the determined laundry amount QL may be communicated to the user by displaying a numeric value and/or by graphic representations. For example, the graphic representations may comprise one or more broken lines wherein any portion of the line may be associated to a numeric value and, in usage, is displayed (activated) based on the determined laundry amount.

According to the present invention, the prefixed time Δts of the constant speed phase S(k) may be set according to the time spent by the drum 6 to complete a prefixed number RN of revolutions at the reference speed B2, wherein RN is an integer number. According to an exemplary embodiment of the present invention, the prefixed number RN of revolutions at the reference speed B2 is two. In this regards it is pointed out that Applicant has found that the mean torque calculated on the basis of the torque values sampled during a time spent by the drum to complete a whole rotation is not affected from load unbalances. Indeed, during its rotation, the drum 6 may be subjected to several fluctuations which however are distributed in opposite position one to the other, and thus tend to mutually cancel out each other in the computation of the average torque.

According to the present invention the sampling time Δta of the torque during the acceleration ramp Ra(k) is comprised in the range from about $0.1*10^{-3}$ seconds to about $20*10^{-3}$ seconds, preferably Δta is about $10*10^{-3}$ seconds, and the sampling time Δtb of the torque during the speed constant phase SPF(k) is comprised in the range from about $0.1*10^{-3}$ seconds to about $50*10^{-3}$ seconds, preferably Δtb is about $10*10^{-3}$ seconds.

Applicant has found that if the sampling time of the torque (Δta, Δtb) is a multiple of the motor control loop, which may be $1*10^{-3}$ seconds when the frequency of the electrical power which supplies the motor is 50 Hz, the accuracy of the calculation of the laundry amount is increased and the sampling is easier to manage.

Figure 6:
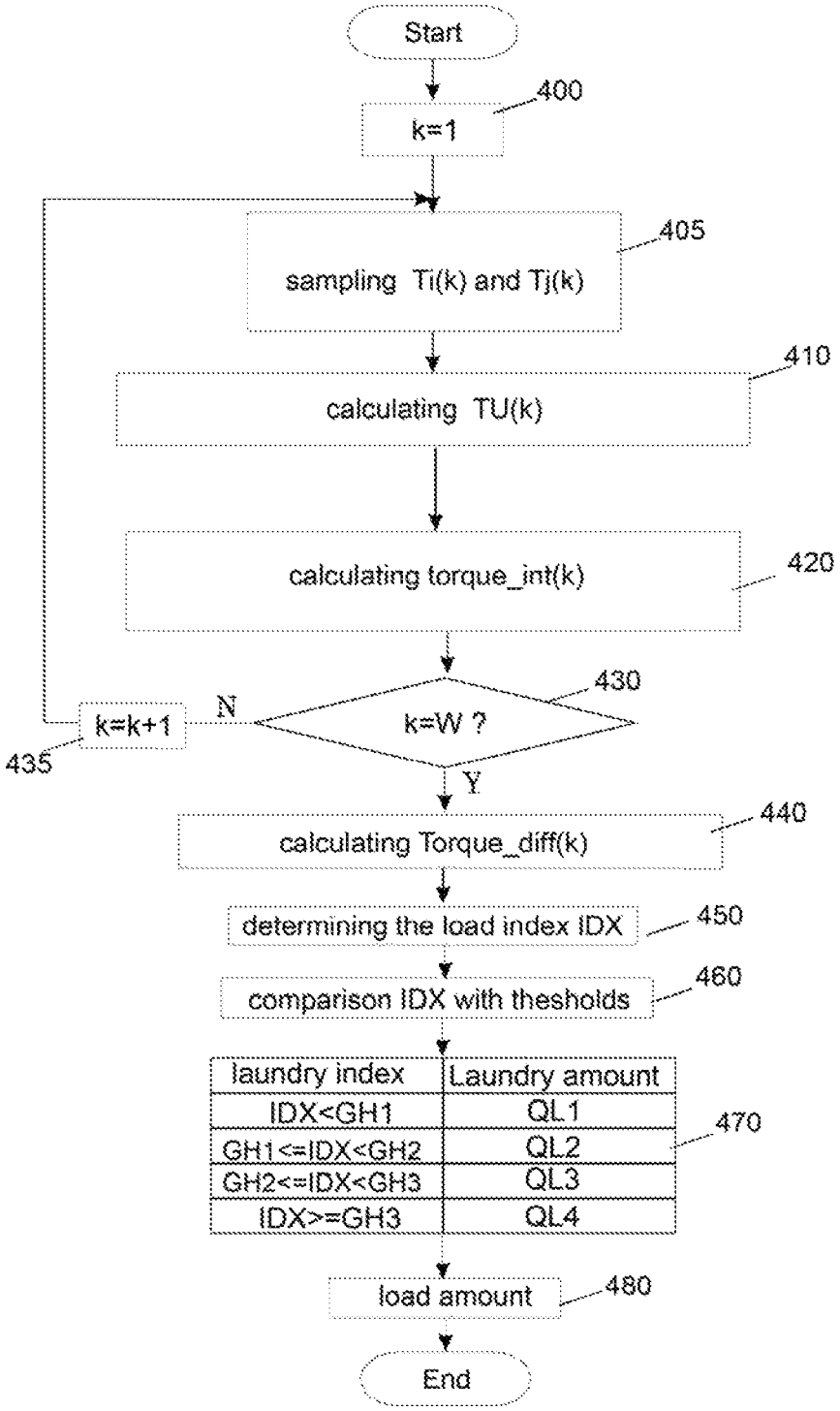
FIG. 6 is a flow chart illustrating the steps performed by the method for determining the amount of laundry load in the rotating drum in accordance with a second embodiment of the present invention.

The advantageous embodiment shown in FIG. 6 relates to a flow chart comprising the steps of the method for determining the laundry amount, which is similar to the flow chart illustrated in FIG. 4, the block of which will be indicated, where possible, with the same reference numbers which identifies corresponding blocks of the flow chart illustrated in FIG. 4.

The method performed by the flow chart illustrated in FIG. 6 differs from the method of the flow chart in FIG. 4 because, instead of determining the laundry load amount QL based on torque samples Ti and Tj, which have been sampled during only a single speed commutation SCP(k), the determination of the laundry load amount QL is based on torque samples Ti(k) and Tj(k) sampled during a sequence of speed commutation phases SCP(k).

According to the exemplary embodiment shown in FIG. 6, the method comprises the step of: setting the index k=1 indicating the numeric order of the commutation phase SCP(k) (block 400), sampling the motor torque Ti(k) during the acceleration ramp Ra(k) of the commutation phase SCP(k) (block 405), sampling the motor torque Tj(k) during the constant speed phase S(k) of the commutation phase SCP(k) (block 405), and calculating the value indicative of the average torque TU(k) based on motor torque Tj(k) values sampled during the constant speed phase S(k) (block 410).

The method further comprises the step of performing the approximate integral calculus (preferably summation as in the example) of the torques values Ti(k) sampled during the acceleration ramp Ra(k) of the commutation phase SCP(k) to determine a value according to the following equation:

$$[(\Sigma_{i=1}^{N} Ti(k)] \quad \text{Equation 5):}$$

The method further comprises the step of determining the Torque_int(k).

In detail the method performs the following equation (block 420):

$$Torque_int(k)=[\Sigma_{i=1}^{N}(Ti(k)-TU(k))]*\Delta ta \quad \text{Equation 6):}$$

Afterwards the method checks if the index k is equal to a value W (block 430), and if not (N output from block 430), the method repeats the same steps disclosed in blocks 405-420, i.e. calculate the average torque TU(k), and determine the values Torque_int(k).

If yes (Y output from block 430), the method calculates, for each commutation phase SCP(k), a value corresponding to the differential value Torque_diff(k) according to the following equation (block 440):

$$\text{Torque_diff}(k)=\text{Torque_int}(k)-(1/W)*[(\Sigma_{k=1}{}^{W}\text{Torque_int}(k)] \quad \text{Equation 7):}$$

For example, if the reference speed profile comprises four commutation phase SCP(k), the methods calculates four differential values: Torque_diff(1), Torque_diff(2), Torque_diff(3) and Torque_diff(4).

With reference to the FIG. 6, the method further calculates the laundry load index IDX which is indicative of the laundry load within the drum (block 450) based on the values Torque_int(k) and the differential value Torque_diff (k).

In detail, the method may preferably calculate the laundry load index value IDX by implementing the following equation:

$$\text{IDX}=\Sigma_{K=1}{}^{W}Ak*\text{Torque_int}(k)+\Sigma_{K=1}{}^{W}Bk*\text{Torque_diff}(k) \quad \text{Equation 8):}$$

For example, if the reference speed profile comprises four speed commutation phases SCP(k), the laundry load index value IDX is calculated by:

$$\text{IDX}=A1*\text{Torque_int}(1)+A2*\text{Torque_int}(2)+A3*\text{Torque_int}(3)+A4*\text{Torque_int}(4)+B1*\text{Torque_diff}(1)+B2*\text{Torque_diff}(2)+B3*\text{Torque_diff}(3)+B4*\text{Torque_diff}(4)$$

Wherein Ak and Bk are constant parameters experimentally calculated (by the Applicant) and preferably memorized in the memory device 21.

Moreover, the method may preferably compare the laundry load index IDX with one or more thresholds GHi (i comprised between 1 and d) associated with corresponding amount of laundry and determine the laundry amount based on the comparison results (block 460).

With reference to the exemplary embodiment illustrated in FIG. 6 (block 470), the method may preferably comprise a number of determined threshold GHi, i.e. preferably three thresholds GH1, GH2, GH3 (d=3). In detail, if the laundry load index IDX is lower than the first threshold GH1, i.e. IDX<GH1 the method determine the first amount QL1 (wherein the amount is a determined weight); whereas if the laundry load index IDX is comprised in the range delimited by a first and second threshold GH1 and GH2, i.e. GH1<=IDX<=GH2 the method determine the second amount QL2; if the laundry load index IDX is comprised in the range delimited by the second and third thresholds GH2 and GH3, the third amount QL3 is determined; whereas if laundry load index IDX is greater that the threshold GH3, the fourth amount QL4 is determined.

In accordance to an alternative embodiment of the present invention, referring now to FIGS. from 7 to 12, flow charts of a method for determining the amount of laundry load QL in the drum 6 are illustrated.

The sequence of steps illustrated for this method is for illustrative purposes only, and is not meant to limit the method in any way as it is understood that the steps may proceed in a different logical order or additional or intervening steps may be included without detracting from the invention. The method may be implemented in any suitable manner, such as automatically, as a stand-alone phase or cycle of operation or as a phase of an operation cycle of the washing machine 1.

Figure 7:
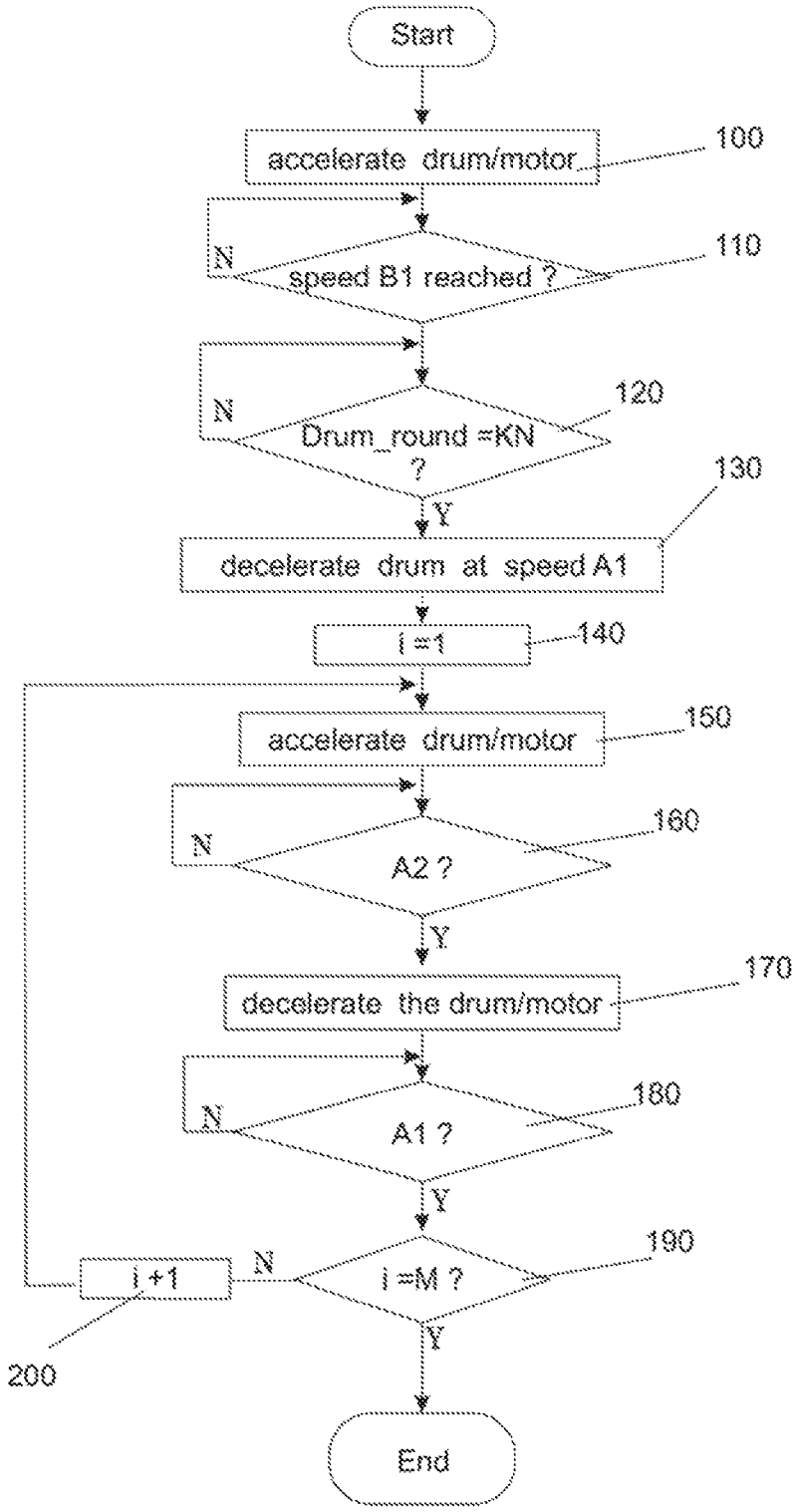
FIG. 7 is a flow chart illustrating the operations of the motor for determining the amount of laundry load in the rotating drum, in accordance with an alternative embodiment of the present invention.
Figure 8:
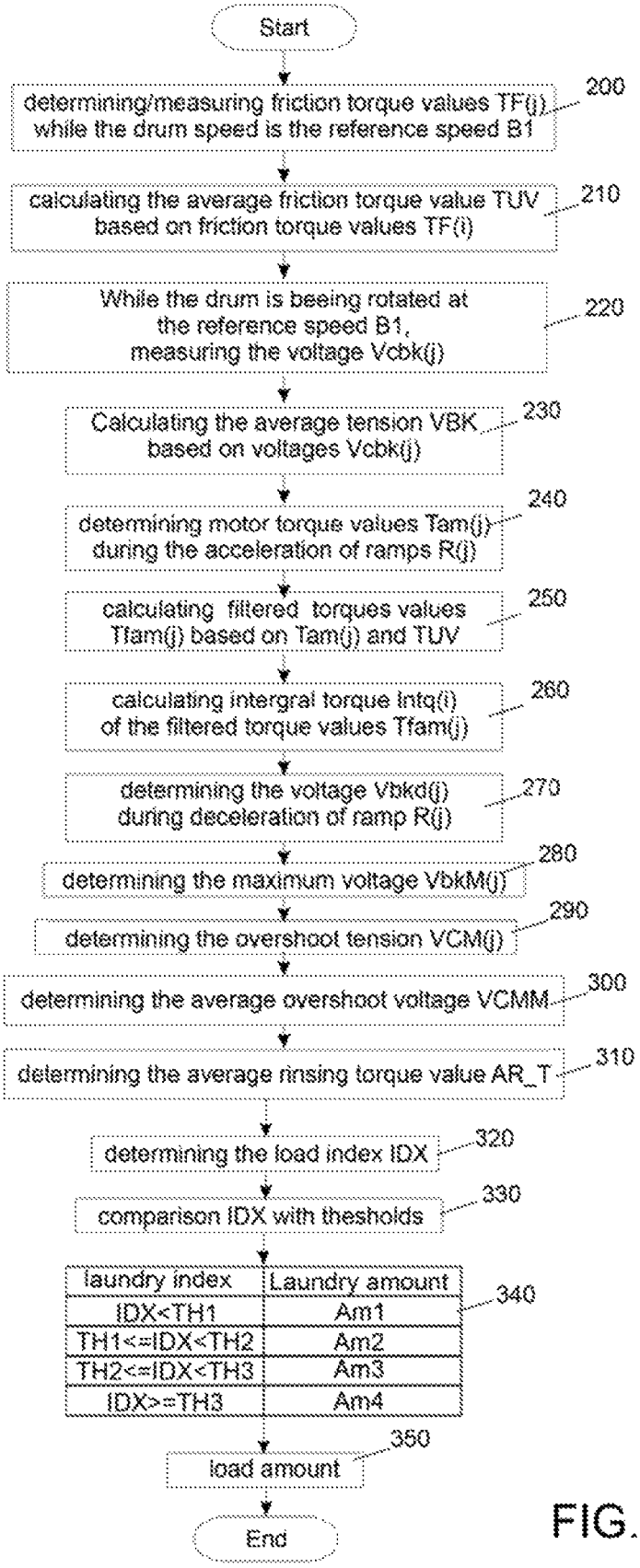
FIG. 8 is a flow chart illustrating the method for determining the amount of laundry load in the rotating drum, in accordance with an alternative embodiment of the present invention.

FIG. 7 is a flow chart comprising the operation of the motor 16 for determining the amount of laundry load of the laundry treating machine 1 in accordance with the alternative embodiment of the present invention, whereas FIG. 8 is a flow chart illustrating the steps performed by the method for determining the amount of laundry load of a laundry treating machine in accordance with the alternative embodiment of the present invention.

Figure 9:
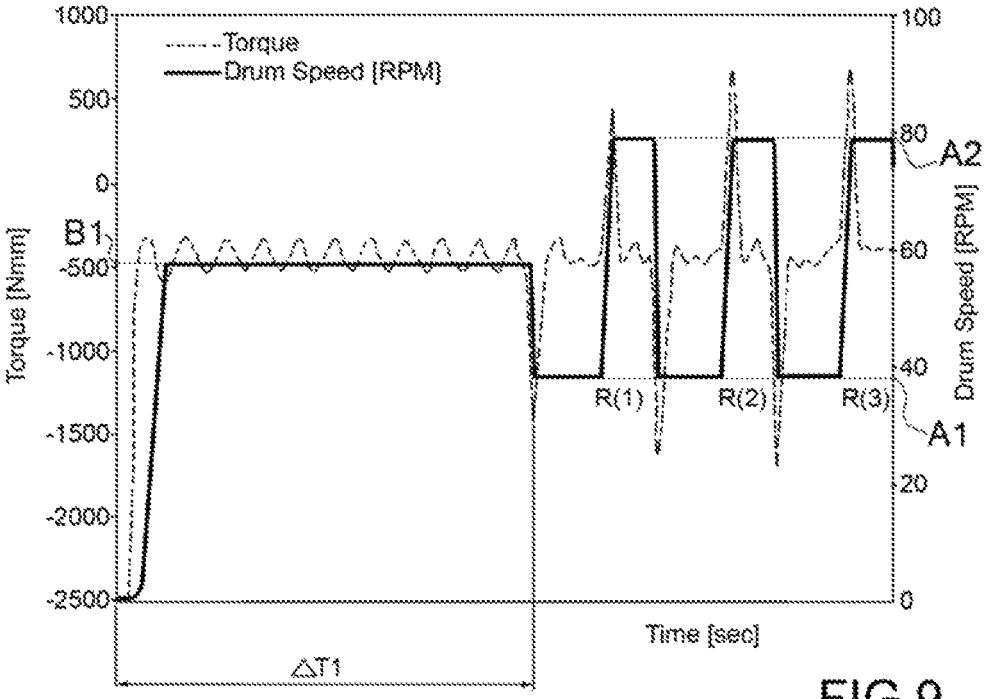
FIG. 9 illustrates a chart of the reference speed profile of said alternative embodiment of the present invention and the torque provided to the drum by the motor when the drum rotates according to the reference speed profile.
Figure 10:
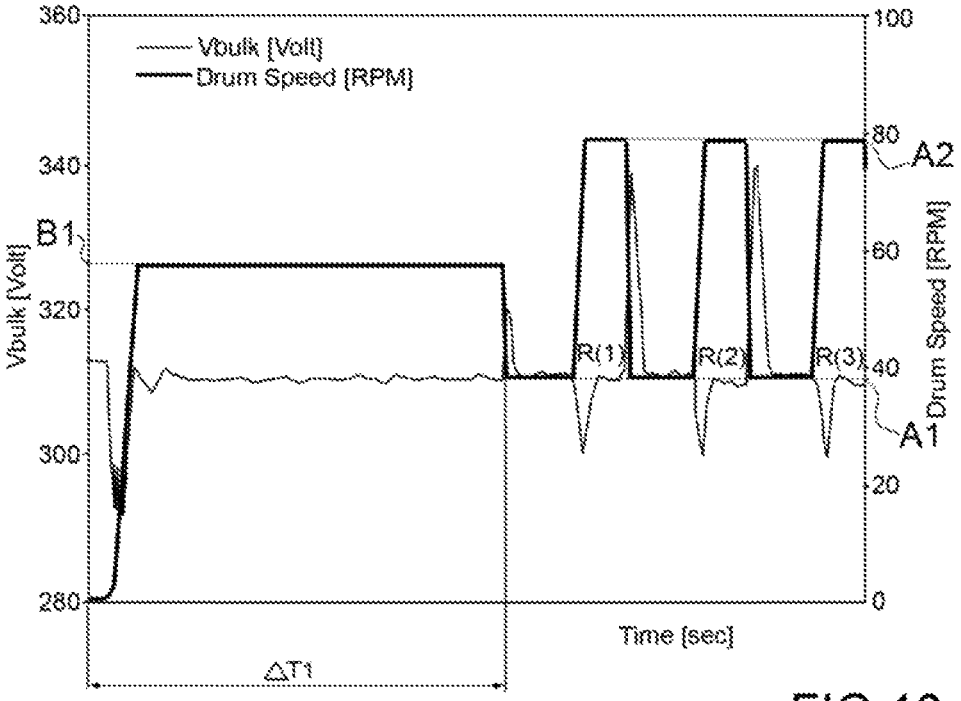
FIG. 10 illustrates a chart of the reference speed profile of said alternative embodiment of the present invention and the buck tension across the capacitor circuit coupled with the power inverter which controls the motor, when the drum rotates according to the reference speed profile.

More in detail, the flow chart in FIG. 7 comprises the steps performed by the method to drive the motor 16 in order to rotate the drum 6 according to an alternative reference speed profile being illustrated in the FIGS. 9 and 10, whereas the flow chart of FIG. 8 comprises the steps implemented by the method to calculate the amount of laundry in the drum 6, when the speed of the drum 6 is varied according to said alternative reference speed profile.

With reference to the exemplary embodiment illustrated in FIGS. 9 and 10, the alternative reference speed profile may comprise a first and a second part. In the first part of the reference speed profile, the motor 16 is preferably driven in order to maintain the rotational speed of the drum 6 at one determined reference speed B for a determined first time ΔT1.

Regarding the second part of the reference speed profile, it preferably although not necessary starts when the first time ΔT1 elapses. During the second part of the reference speed profile, the motor 16 is driven to cause the drum 6 to perform one or more acceleration/deceleration ramps R(i). The rotational speed of the drum 6, during the acceleration/deceleration ramps R(i), varies between a determined first target rotational speed A1 and a second target rotational speed A2 which is greater than the first target speed, i.e. A2>A1.

The applicant has found that the number of acceleration/deceleration ramps R(i) of the reference speed profile may be conveniently comprised between two and four, preferably three ramps R(i).

It should in any case be understood that the present invention is not limited to reference speed profile having deceleration ramp starting immediately after the top peak of the acceleration ramp has been reached as illustrated in the example of FIGS. 9 and 10, in which the deceleration ramp follows the acceleration ramp without interruption. Indeed, according to different embodiments, it may be envisaged that reference speed profile may further comprise additional determined variations and/or constant speed between the acceleration ramp and the corresponding deceleration ramp. During the acceleration ramp R(i), the motor operates in a "motor mode", whereas during the deceleration ramp R(i) the motor brakes the drum 6 and operates in a "generator mode".

According to the exemplary embodiment illustrated in FIGS. 9 and 10, the reference speed B of the drum 6 may be preferably comprised in the range from 30 to 80 RPM, preferably 50 or 80 RPM, whereas the first target rotational speed A1 may be preferably comprised in the range from 30 to 50 RPM, preferably 40 RPM, and the second target rotational speed A2 may be preferably comprised in the range from 70 to 90 RPM, preferably 80 RPM.

Preferably, the first prefixed time ΔT1 may be set according to the time spent by the drum 6 to complete a prefixed number KN of revolutions at the reference speed B, wherein KN is an integer number.

The method starts at the beginning of the laundry treating cycle, with assuming that the user has placed one or more laundry items QL for treatment within the drum 6, selected laundry treating program through the user Interface 19, and started of performing the selected laundry treating program.

Moreover, it is assumed that control circuit 18 may preferably have performed a known draining phase/procedure in which the drain apparatus 13 has drained remaining liquid/water present in the washing machine 1. In detail, the user loads the laundry and then presses start. At the beginning of the cycle a drain pump, if present, may be preferably activated to drain the remaining water in the washing tub 3; preferably, right after the draining phase, some movements may be performed (without loading water) to detect the amount of laundry. The information extrapolated from the movements may be used for setting some washing cycle parameters and to give some information to the customer, like estimated cycle length and/or the determined amount of laundry.

With reference to the flow chart illustrated in FIG. 7, the control circuit 18 drives the motor 16 by means of the motor controller 23 in order that the speed of the drums 6 tracks the reference speed profile. Non-limiting example of the reference speed profile performed by the method, used with the aim to improve the understanding of the present invention is illustrated in FIGS. 9 and 10.

At blocks 100-130, the control circuit 18 drives the motor 16 by means of the motor controller 23 in order to preferably perform the first part of the reference speed profile. The motor 16 may be driven to cause the drum 6 to rotate at the prefixed reference speed B during the first time ΔT1. This may comprises accelerating the drum 6 until the speed of the drum 6 reaches the prefixed reference speed B (block 100) and verifying whether the prefixed reference speed B is reached (block 110). If the drum speed does not reach the reference speed B. (output N from block 110), the motor 16 continues to accelerate the drum 6, whereas, on the contrary, when the drum speed reaches the reference speed B (output Y from block 110), the control circuit 18 drives the motor 16 in order to maintain the drum speed at the reference speed B for the first time ΔT1 (output N from block 120). In the exemplary embodiment illustrated in FIG. 7, the method maintains the drum speed at the reference speed B for a determinate number KN of drum revolutions Drum_round. It is understood that the control circuit 18 calculates, time by time, the performed drum revolutions Drum_round and compare this value with the prefixed number KN.

After the first time ΔT1 elapses. i.e. when the performed drum revolutions Drum_round reaches the determined number KN (output Y from block 120), the motor 16 decelerates the drum 6 so that the speed of the drum 6 is reduced from the reference speed B preferably to said first target speed A1 (block 130).

Thereafter, at blocks 140-200, the control circuit 18 drives the motor 16 by means of the motor controller 23 in order to cause the drum 6 to accelerate/decelerate according to one or more acceleration/deceleration ramps R(i) comprised in the second part of the reference speed profile (FIGS. 9 and 10).

This may preferably comprise the steps of: setting a ramp counter i=1 (block 140) which is designed to count the performed ramps R(i), and accelerating the drum 6 (block 150) until the speed of the drum 6 reaches the second target speed A2 (block 160). While the drum 6 is being accelerated, the motor operates in "motor mode" and the motor torque varies as illustrated in FIG. 9 (illustrated with a broken line) based on the amount of laundry contained in the drum 6 accelerated. In other words the variation of motor torque during the acceleration ramp is correlated to the laundry load.

According to the example illustrated in FIGS. 9 and 10, when the speed of the drum 6 reaches the second target speed A2 (Outputs Y from the block 160), the control circuit 18 drives the motor 16 to cause the drum 6 to decelerate (block 170) in order that speed of the drum 6 reduces from the second target speed A2 to the first target speed A1 (block 180). During the deceleration ramp R(i), the motor operates in generator mode.

When the control circuit 18 determines that the drum 6 rotates at the first target speed A1 (outputs Y from the block 180) and thus the acceleration/deceleration ramp R(i) has been completed, the control circuit 18 checks the ramp counter i (block 190) to determine whether a new acceleration/deceleration ramp R(i) has to be performed.

If yes (N output from block 190), the ramp counter "i" is increased i+1 (block 200) and the method repeats the steps disclosed in blocks 150-190, while if not (outputs Y from block 180), i.e. the ramp counter "i" reaches a determined threshold number M corresponding to the number of ramps of the reference speed profile to be performed, the methods ends.

With reference to the flow chart illustrated in FIG. 8 and the example illustrated in FIGS. 9 and 10, while the speed of the drum 6 is being maintained at the reference speed B, i.e. during the first time ΔT1 (blocks 110 and 120 in FIG. 7), the method may preferably repeatedly determine a value which is indicative of the motor torque TF(j). More specifically, the control circuit 18 may receive one or more signals from the motor 16 and/or from the motor torque sensor 20 and determines/samples the motor torque TF(j) (wherein with j is a sampling index) based on these signals. Preferably, the signal may comprise electric values indicative of the current supplied to the motor by the inverter device 26.

Preferably, the method may further determine/calculate an average torque value TUV based on the motor torques TF(j) (block 210). For example, the average torque value TUV may be determined by performing an arithmetic mean of the measured torques values TF(j). Preferably, the average torque value TUV may be memorized in the memory device 21. It is understood that average torque value TUV is substantially indicative of the torque needed to contrast friction of the washing machine.

Preferably, while the speed of the drum 6 is being maintained at the prefixed reference speed B during the first time ΔT1 (blocks 110 and 120 in FIG. 7), the method may repeatedly determine the voltage Vcbk(j) (wherein with j is a sampling index) across the energy storage circuit, i.e. the capacitor circuit 25 (block 220). It is understood that if the energy storage circuit comprises one or more batteries, the determined voltage Vcbk(j) corresponds to the voltage measured across the battery terminals.

More specifically, the control circuit 18 may receive one or more signals from the voltage sensing unit 27 and determine an average tension value VBK of the capacitor circuit 25 based on the sampled voltages Vcbk(j). The average tension value VBK may be determined by performing, for example, an arithmetic mean of the measured voltages Vcbk(j). The average tension value VBK calculated during the first time Δt1 is a voltage reference value which, as hereinafter disclosed in detail, will be used to determine the overshoot of the electric voltage across the capacitor circuit 25 when the electric motor 16 operates in the generator mode (block 230).

It is understood that the steps performed in blocks 220 and 230 in FIG. 8 to determine the average tension value VBK may be further performed, in alternative or in addition to the above cited solution, when the rotational speed of the drum 6 is approximately stable at a certain value, which could be different from the reference speed B.

Preferably, while the drum 6 is being accelerated according to the ramp R(i) (block 150 of FIG. 7), the method may repeatedly sample motor torque values Tam(j) (block 240) in FIG. 8.

In detail, the motor torque values Tam(j) may be sampled at determined sampling times Δtime.

Thereafter, the method may preferably calculate (normalized) filtered torques values Tfam(j) (j comprised between 1 and N) based on said sampled motor torque values Tam(j) and said memorized average torque value TUV (block 250), by implementing the following equation:

$$Tfam(j)=Tam(j)-TUV \qquad \text{Equation 1):}$$

It is pointed out that the filtered torques Tfam(j) are indicative of the motor torques needed for accelerating the laundry load, without frictions.

Preferably, while the drum 6 is being accelerated, the method performs an approximate integral calculus (summation in the example) of the filtered torques values Tfam(j) (block 260 in FIG. 8) and the sampling time Δtime, in order to determine a integral value Intq(i) by implementing the following equation:

$$Intq(i)=\Sigma_{j=1}^{N}\Delta\text{time}*Tfam(j) \qquad \text{Equation II):}$$

Wherein N is the number of the determined filtered torque values Tfam(j), i.e. represents the number of torque samples during an acceleration ramp R(i), whereas the parameter i indicates the ramp R(i) performed by the method, and $\Delta time_j$ is the sample time.

Therefore, during the acceleration ramps R(i), so when the motor accelerates from speed A1 to speed A2, an integral of the "filtered" motor torques (Tfam(j)) may be computed: the integrated values Intq(j) are then stored in the memory device 21 for each ramp R(i).

In any case, it is understood that the calculation of integral value Intq(i) is not limited to the equation 2) but it could be used an integral mathematical function or the like.

Thereafter, while the drum 6 is being decelerated according to the ramp R(i) and thus the motor 16 is operating in generator mode, the method may repeatedly sample the voltages Vbkd(j) (j comprised between 1 and N) across the capacitor circuit 25 (block 270 in FIG. 8). In detail, the voltages Vbkd(j) of the capacitor circuit 25 may be sampled at said sampling times Δtime.

Thereafter, the method determines a maximum value VbkM(i) of the voltages Vbkd(j), i.e. the voltage having the maximum peak calculated with respect to the average tension value VBK (block 280).

Thereafter, the method calculates the overshoot tension values VCM(i) by subtracting the average tension value VBK from the respective maximum values VbkM(i) (block 290).

After the reference speed profiled has been completed, i.e. all the M raps R(i) have been performed, the method calculates: an average overshoot tension VCMM based on the overshoot tension values VCM(i) determined during all the M ramps R(i) (block 300).

It is pointed out that the average overshoot tension VCMM may be calculated by performing an arithmetic mean of the overshoot tension values VCM(i), preferably by implementing the following equation:

$$VCMM=\left(\frac{1}{M}\right)*\sum_{i=1}^{M}VCM(i) \qquad \text{Equation III)}$$

Preferably, the method further calculates an average rising torque value AR_T based on the integral values Intq(i) determined during the ramps R(i) (block 310), by performing the following equation:

$$\text{AR_T}=\left(\frac{1}{M}\right)*\sum_{i=1}^{M}Intq(i) \qquad \text{Equation IV)}$$

Wherein M represents the number of rising ramps (in FIGS. 9 and 10, M is equal to 3).

Once the average overshoot tension VCMM and preferably the average rising torque value AR_T have been calculated, the method may preferably calculate a laundry load index value IDX which is indicative of the laundry load within the drum (block 320).

In detail, the method may preferably calculate the laundry load index value IDX by implementing the following equation:

$$\text{IDX}=K1*AR_T+K2*VCMM \qquad \text{Equation V):}$$

Wherein K1 and K2 are constant parameters experimentally calculated (by the Applicant) and preferably memorized in the memory device 21.

Moreover, the method may preferably compare the laundry load index IDX with one or more thresholds Thi (i comprised between 1 and d) associated with corresponding amount of laundry and determine the laundry amount based on the comparison results (block 320).

With reference to the exemplary embodiment illustrated in FIG. 8 (block 340), the method may preferably comprise a number of determined threshold THi, i.e. preferably three thresholds TH1, TH2, TH13 (d=3). In detail, if the laundry load index IDX is lower than the first threshold TH1, i.e. IDX<TH1 the method determine the first amount AM1 (wherein the amount is a determined weight), whereas if the laundry load index IDX is comprised in the range delimited by a first and second threshold TH1 and TH2, i.e. TH I<=IDX<=TH2 the method determine the second amount AM2, if the laundry load index IDX is comprised in the range delimited by the second and third thresholds TH2 and TH3, the third amount AM3 is determined, whereas if laundry load index IDX is greater that the threshold TH3, the fourth amount AM4 is determined.

After determining the laundry load amount, the method preferably displays such value to the user by the user interface 19 and/or preferably set several parameters of the washing cycle, such as for example, the amount of water/detergent to be loaded, the cycle duration, and other washing parameters, based on the determined laundry amount.

According to the present invention, the determined laundry amount may be communicated to the user by displaying a numeric value and/or by graphic representations. For example, the graphic representations may comprise one or more broken lines wherein any portion of the line may be associated to a numeric value and, in usage, is displayed (activated) based on the determined laundry amount.

Figure 11:
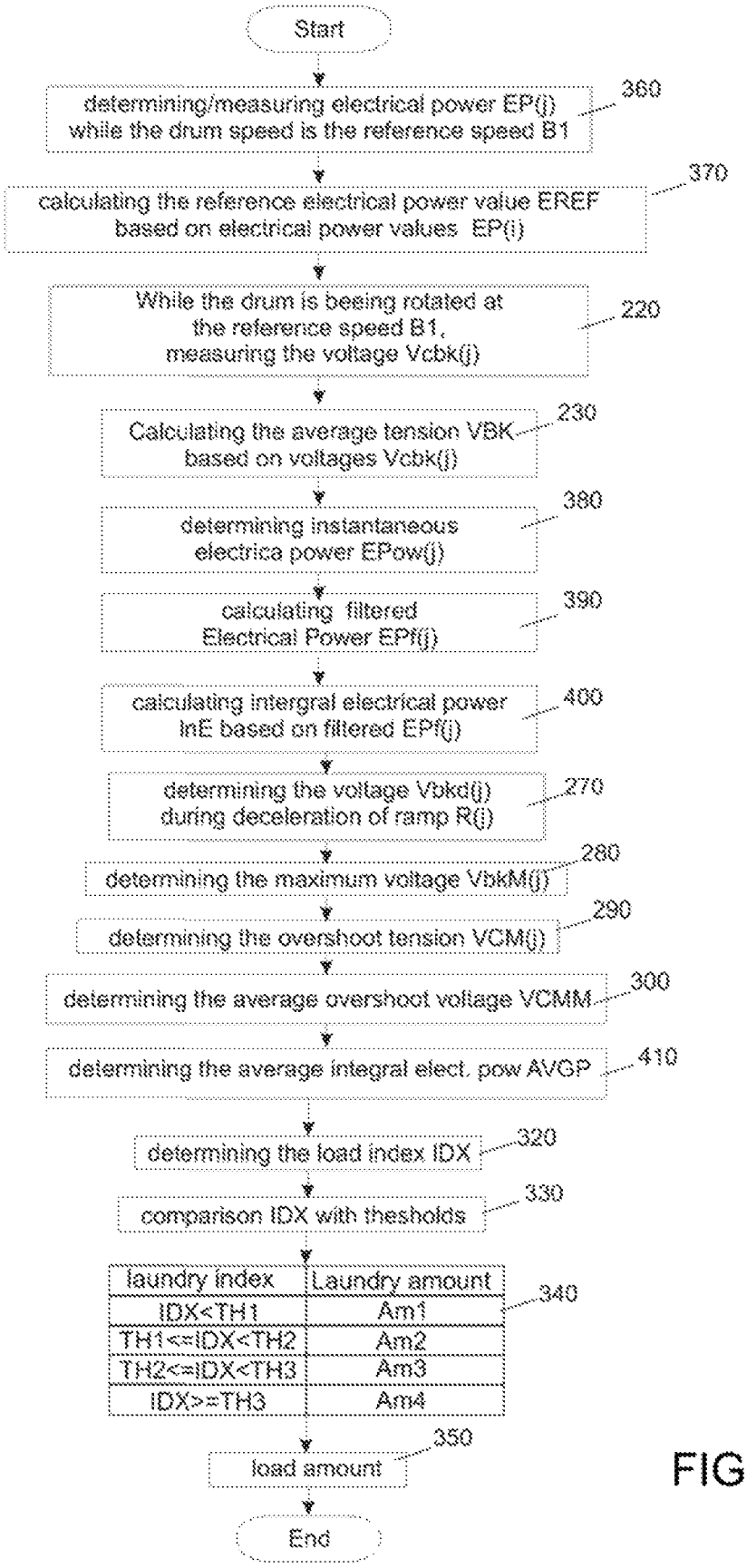
FIG. 11 is a flow chart illustrating the operations performed by method for determining the amount of laundry load in the rotating drum in accordance with the alternative embodiment of the present invention.

The advantageous embodiment shown in FIG. 11 relates to a flow chart comprising the steps of the method for determining the laundry amount, which is similar to the flow chart illustrated in FIG. 8, the block of which will be indicated, where possible, with the same reference numbers which identifies corresponding blocks of the flow chart illustrated in FIG. 8.

The method performed by the flow chart in FIG. 11 differs from the method of the flow chart in FIG. 8 because, instead of using the motor torque as the first parameter, it uses the electrical power supplied by the power inverter device 26 to the motor 16.

With reference to the flow chart illustrated in FIG. 11, while the speed of the drum 6 is being maintained at the reference speed B, i.e. during the first time ΔT1 (blocks 110 and 120 in FIG. 7), the method may preferably determine motor values which are indicative of the instantaneous motor electrical powers EP(j). More specifically, the control circuit 18 may receive one or more signals from the motor 16 and/or from the motor controller 23 being indicative of the electrical quantities/parameters, i.e. tensions/currents supplied to the motor 16 and preferably determine the instantaneous motor electrical powers EP(j) (j comprised between 1 and N) based on these signals (block 360 in FIG. 11).

Preferably, the method may further determine/calculate an average value of the motor electrical power hereinafter called EREF based on the motor electrical powers EP(j (block 370). For example, the average motor electrical power EREF may be determined by performing an arithmetic mean of the instantaneous motor electrical power EP(j). Preferably, the average motor electrical power EREF may be memorized in the memory device 21. It is understood that the average motor electrical power EREF is substantially indicative of the electrical power needed to the motor to contrast the friction of the washing machine.

In the block 380 of FIG. 11, which replaces the block 240 of the flow chart of FIG. 8, the method preferably determines, during the acceleration ramps R(i), the instantaneous motor electrical powers EPow(j) (j comprised between 1 and N).

Thereafter, in the block 390, which replaces the block 250 of the flow chart of FIG. 8, the method determines a filtered electrical power EPf(j) (j comprised between 1 and N) based on said instantaneous motor electrical powers EPow(j) and said memorized average motor electrical power EREF, by implementing the following equation:

$$EPf(j)=E\mathrm{Pow}(j)-E\mathrm{REF} \qquad \text{Equation VI):}$$

It is pointed out that the filtered electrical powers EPf(j) are indicative of the energy needed for accelerating the laundry load, without frictions.

While the drum 6 is being accelerated, the method preferably performs an approximate integral calculus (summation in the example) of the filtered electrical powers values EPf(j) (block 400 in FIG. 11) and the sampling time Δtime, in order to determine a integral value InE(i) by implementing the following equation:

$$InE(i)=\Sigma_{j=1}^{N}\Delta\mathrm{time}*EPf(j) \qquad \text{Equation VII):}$$

Wherein N is the number of the determined filtered electrical powers EPf(j), whereas the parameter i indicates the ramp R(i) performed by the method.

In any case it is understood that the calculation of integral value IntE(i) is not limited to the equation VII) but it could be used an integral mathematical function or the like.

Moreover, in the block 410 which replaces the block 310 of FIG. 8, the method preferably calculates an average integral electric power value AVGP based on the integral values InE(i) determined during the M ramps R(i) by performing the following equation:

$$AVGP=\left(\frac{1}{M}\right)*\sum_{i=1}^{M} IntE(i) \qquad \text{Equation VIII)}$$

Once the average integral electric power value AVGP and the average overshoot tension VCMM (block 300 in FIG. 11) have been calculated, in the block 320, the method calculates a laundry load index value IDX which is indicative of the laundry load within the drum 6.

In detail, the method calculates the laundry load index value IDX by implementing the following equation:

$$\mathrm{IDX}=K3*\mathrm{AVG}P+K4*VCMM \qquad \text{Equation IX):}$$

Wherein K3 and K4 are memorized constant parameters experimentally calculated by the applicant and preferably memorized in the memory device 21.

Thereafter, the method performs the above disclosed steps of blocks 330-350 (FIG. 11) wherein the laundry load index IDX is compared with one or more thresholds Thi, and determine the laundry amount based on the comparison results.

Figure 12:
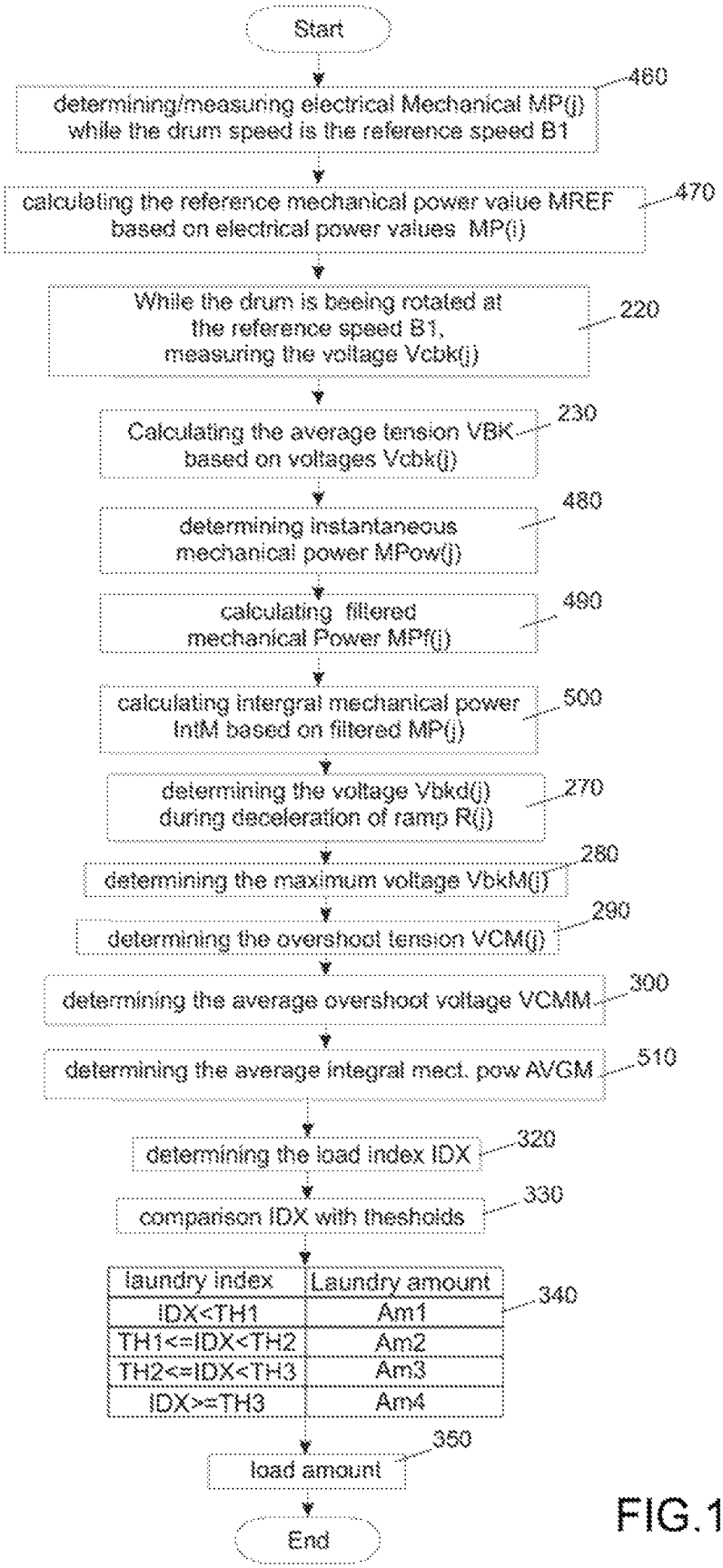
FIG. 12 is a flow chart illustrating the operations performed by method for determining the amount of laundry load in the rotating drum in accordance with the alternative embodiment of the present invention.

The advantageous embodiment shown in FIG. 12 relates to a flow chart comprising the steps of the method for determining the laundry amount, which is similar to the flow chart illustrated in FIG. 8, the block of which will be indicated, where possible, with the same reference numbers which identifies corresponding blocks of the flow chart illustrated in FIG. 8.

The method performed according to the flow chart in FIG. 12 differs from the method performed on the basis of the steps of the flow chart illustrated in FIG. 8 because, instead of using the motor torque as the first parameter, it uses the mechanical power generated by the motor 16.

With reference to the flow chart illustrated in FIG. 12, while the speed of the drum 6 is being maintained at the reference speed B, i.e. during the first time ΔT1 (blocks 110 and 120 in FIG. 7), the method may repeatedly determine motor values which are indicative of the instantaneous motor mechanical power MP(j). More specifically, the control circuit 18 may receive one or more signals from the motor speed sensor 22 and the motor torque sensor 20 being indicative of the motor speed and motor torque, respectively, and determine the instantaneous motor mechanical power MP(j) based on speed and torque signals (block 460 in FIG. 12).

The method may further determine/calculate an average value of the motor mechanical power hereinafter called MREF based on the motor mechanical power values MP(j) (block 470). For example, the average motor mechanical power MREF may be determined by performing an arithmetic mean of the instantaneous motor mechanical power MP(j). Preferably, the average motor mechanical power MREF may be memorized in the memory device 21. It is understood that the average motor mechanical power MREF is substantially indicative of the mechanical power needed to the motor 16 to contrast the friction of the washing machine 1.

In the block 480 of FIG. 12, which replaces the block 240 of the flow chart of FIG. 8, the method preferably determines, during the acceleration ramps R(i), the instantaneous motor mechanical powers MPow(j) (j comprised between 1 and N).

Thereafter, in the block 490, which replaces the block 250 of the flow chart of FIG. 8, the method may determine a filtered mechanical power MPf(j) (j comprised between 1 and N) based on said instantaneous motor mechanical powers MPow(j) and said memorized average motor mechanical power MREF, by implementing the following equation:

$$MPf(j)=M\mathrm{Pow}(j)-M\mathrm{REF} \qquad \text{Equation X):}$$

It is pointed out that the filtered mechanical power values MPf(j) are indicative of the mechanical power needed for accelerating the laundry load by the motor 16, without frictions. While the drum 6 is being accelerated, the method may perform an approximate integral calculus (summation in the example) of the filtered mechanical powers values MPf(j) (block 500) and the sampling time Δtime, in order to determine a integral value InM(i) by implementing the following equation:

$$InM(i)=\Sigma_{j=1}^{N}\Delta time*MPf(j) \qquad \text{Equation XI):}$$

Wherein N is the number of the determined filtered mechanical powers MPf(j), whereas the parameter i indicates the ramp R(i) performed by the method.

In any case, it is understood that the calculation of integral value IntM(i) is not limited to the equation XI) but it could be used an integral mathematical function or the like.

Moreover, in the block 510 which replaces the block 310 of FIG. 8, the method may calculate an average integral mechanical power value AVGM based on the integral values InM(i) determined during the M ramps R(i) by implementing the following equation:

$$AVGM=\left(\frac{1}{M}\right)*\sum_{i=1}^{M}IntM(i) \qquad \text{Equation XII)}$$

Once the average integral electric power value AVGM and the average overshoot tension VCMM have been calculated, in the block 320 the method calculates a laundry load index value IDX which is indicative of the laundry load within the drum 6.

In detail, the method may calculate the laundry load index value IDX by implementing the following equation (Block 320):

$$IDX=K5*AVGM+K6*VCMM \qquad \text{Equation XIII):}$$

Wherein K5 and K6 are memorized constant parameters experimentally calculated by the applicant and preferably memorized in the memory device 21.

Thereafter, the method performs the above disclosed steps of blocks 330-350 wherein the laundry load index IDX is compared with one or more thresholds Thi, and determine the laundry amount based on the comparison results.

While the present invention has been described with reference to the particular embodiments shown in the figures, it should be noted that the present invention is not limited to the specific embodiments illustrated and described herein; on the contrary, further variants of the embodiments described herein fall within the scope of the present invention, which is defined in the claims.

The invention claimed is:

1. A method for determining a laundry load (QL) of a laundry treating machine having an outer casing, a laundry treating group which is placed inside said outer casing and comprises, in turn, a rotatable drum structured for housing the laundry to be treated, and an electric motor for rotating said drum, wherein said method comprises:

controlling the electric motor to cause said drum to change the rotational speed according to a prefixed reference speed profile comprising at least an acceleration ramp (Ra(i)), wherein the drum is accelerated from a low speed (B1) to a prefixed high speed (B2) and at least a constant speed phase S(k) wherein the drum speed is maintained about said high speed (B2), sampling first torque values (Ti) generated by said electric motor during said acceleration ramp Ra(i) according to a prefixed first sample time (Δta), sampling second torque values (Tj) generated by said motor during said constant speed phase S(k) according to a prefixed second sample time (Δtb), calculating a third value (TU), which is indicative of an average torque being calculated, in turn, on the basis of said second torque values (Tj), wherein TU is torque needed to overcome friction, determining a fourth value (Torque_int) by performing an integral function with respect to said first torque values (Ti) and the third value (TU), and determining the amount of laundry load (QL) on the basis of at least said fourth value (Torque_int).

2. The method according to claim 1, wherein said prefixed reference speed profile further comprises a deceleration ramp (Rd(k)) wherein said drum is decelerated from said high speed (B2) to said low speed (B1); said constant speed phase S(k) being performed Immediately after said acceleration ramp (Ra(i)) and immediately before said deceleration ramp (Rd(k)).

3. The method according to claim 2, wherein said reference speed profile comprises a sequence of drum speed commutations (SCP(k)), wherein each drum speed commutation (SCP(k)) comprises said acceleration ramp (Ra(i)), said deceleration ramp ((Rd(k)) and said constant speed phase (S(k)); and for each of said drum speed commutation (SCP(k)), the method comprises the steps of:

sampling said first torque values (Ti) generated by said motor during said acceleration ramp (Ra(i)) according to said first sample time (Δta), sampling said second torque values (Tj) generated by said motor during said constant speed phase (S(k)) according to said second sample time (Δtb), calculating said third value (TU), which is indicative of an average torque being calculated, in turn, on the basis of said second torque values (Tj), and determining said fourth value by performing an integral function with respect to said first torque values (Ti) and the third value (TU); and the method further comprises:

calculating a fifth value which is indicative of the arithmetic mean of said fourth values; and determining the amount of laundry load (QL) on the basis of differential values (Torque_diff), calculated by subtracting said fifth value from said fourth values (Torque_int(k)).

4. The method according to claim 3, wherein said fourth value is determined by performing said integral function with respect to said first torque values (Ti) subtracted of said the third value (TU).

5. The method according to claim 3, wherein said fifth value is calculated according to the following equation:

$$(1/W)*[\Sigma_{k=1}^{W}Torque_int(k)]$$

wherein W is the number of speed commutations SCP(k), Torque_int(k) are the fourth values associated with the respective commutation phases SCP(k).

6. The method according to claim 5, wherein said differential values (Torque_diff(k)) are calculated according to the following equation:

$$Torque_diff(k)=Torque_int(k)-(1/W)*[(\Sigma_{k=1}^{W}Torque_int(k)]$$

wherein W is the number of speed commutations SCP(k), Torque_int(k) are fourth values associated with the commutation phases SCP(k).

7. The method according to claim 5, comprising the steps of:

determining a load index value (IDX) based on said fourth values and said differential values; and determining the amount of the laundry load based on said index value (IDX).

8. The method according to claim 7, comprising the steps of: comparing said laundry load index (IDX) with one or more prefixed thresholds (Thi)(Ghi) associated with respective amounts of laundry (QLi); and determining the laundry amount (QL) based on the comparison results.

9. The method according to claim 1, wherein said fourth value (Torque_int) is determined by performing said integral function with respect to said first torque values (Ti) subtracted of said the third value (TU).

10. The method according to claim 1, wherein said fourth value (Torque_int) is calculated according to the following equation:

$$\text{Torque_int}=[\Sigma_{i=1}^{N}(Ti-TU)]*\Delta ta$$

wherein $T_i$ are the torque values sampled during said acceleration ramp (Ra(k)) at instants i, N is the number of torque values (Ti) sampled during said acceleration ramp (Ra(k)), TU is the average torque calculated during said constant speed phase, and Δta is the first sample time.

11. The method according to claim 1, wherein said fourth value (Torque_int) is calculated according to the following equation:

$$\text{Torque_int}=[(\Sigma_{i=1}^{N}Ti)-(TU*N))]*\Delta ta$$

wherein $T_i$ are the torque values sampled during said acceleration ramp (Ra(k)), N is the number of torque values (Ti) sampled during said acceleration ramp (Ra(k)), TU is the average torque calculated during said constant speed phase, Δta is the first sample time.

12. The method according to claim 1, wherein the method further comprises:

determining a load index value (IDX) based on said fourth value (Torque_int); and determining the amount (QL) of the laundry load based on said index value (IDX).

13. The method according to claim 12, wherein said load index value (IDX) is determined based on the following equation:

$$\text{IDX}=A1*\text{Torque_int}$$

wherein A1 is a constant parameter experimentally calculated and Torque_int is said fourth value (Torque_int).

14. The method according to claim 12, comprising: the steps of comparing said laundry load Index (IDX) with one or more prefixed thresholds (Thi)(Ghi) associated with respective amounts of laundry (QLi); and determining the laundry amount (QL) based on the comparison results.

15. The method according to claim 1, wherein said second sample time (Δtb) of said second torque values (Tj) generated by said electric motor (16) during said constant speed phase (S(k)) is between about $0.1*10^{-3}$ s and about $50*10^{-3}$ s.

16. The method according to claim 1, wherein said second sample time (Δtb) of said second torque values (Tj) generated by said electric motor (16) during said constant speed phase (S(k)) is about $10*10^{-3}$ s.

17. The method according to claim 1, wherein said first sample time (Δta) of said first torque values (Ti) generated by said electric motor during said acceleration ramp (Ra(k)) Is between about $0.1*10^{-3}$ s and $20*10^{-3}$ s.

18. A laundry treatment machine comprising:

an outer casing;

a laundry treating group which is placed inside said outer casing and comprises, in turn, a rotatable drum structured for housing the laundry to be treated;

an electric motor for rotating said drum and an electronic control circuit configured to:

control the electric motor to cause said drum to change the rotational speed according to a prefixed reference speed profile comprising at least an acceleration ramp (Ra(i)), wherein said drum is accelerated from a low speed (B1) to a prefixed high speed (B2) and at least a constant speed phase (S(k)) wherein the drum speed is maintained about said high speed (B2);

sample first torque values (Ti) generated by said motor during said acceleration ramp Ra(i) according to a prefixed first sample time (Δta);

sample second torque values (Tj) generated by said motor during said constant speed phase according to a prefixed second sample time (Δtb);

calculate a third value (TU), which is indicative of an average torque being calculated, in turn, on the basis of said second torque values (Tj), wherein TU is torque needed to overcome friction;

determine a fourth value by performing an integral function with respect to said first torque values (Ti) and said third value (TU); and determine the amount of laundry load (QL) on the basis of at least said fourth value (Torque_int).

* * * * *